US012083385B2

(12) United States Patent
Robinson

(10) Patent No.: US 12,083,385 B2
(45) **Date of Patent: *Sep. 10, 2024**

(54) UNDERWATER PROPULSION DEVICE

(71) Applicant: Brandon C. Robinson, West Palm Beach, FL (US)

(72) Inventor: Brandon C. Robinson, West Palm Beach, FL (US)

(73) Assignee: Brandon C. Robinson, West Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/117,948

(22) Filed: Mar. 6, 2023

(65) Prior Publication Data

US 2023/0201669 A1 Jun. 29, 2023

Related U.S. Application Data

(63) Continuation of application No. 17/518,501, filed on Nov. 3, 2021, now Pat. No. 11,596,839, which is a (Continued)

(51) Int. Cl.
*A63B 31/11* (2006.01)
*A63B 35/12* (2006.01)
(Continued)

(52) U.S. Cl.
CPC ..... *A63B 31/11* (2013.01); *A63B 35/12* (2013.01); *A63C 11/10* (2013.01); *B63C 9/23* (2013.01); *B63C 11/46* (2013.01)

(58) Field of Classification Search
CPC ..... A63B 31/00; A63B 31/11; A63B 35/00; A63B 35/12; A63C 11/00; A63C 11/10;
(Continued)

(56) References Cited

U.S. PATENT DOCUMENTS 3,422,787 A 1/1969 Rush
3,635,188 A 1/1972 Rutkowski
(Continued)

FOREIGN PATENT DOCUMENTS

BE 762369 A 7/1971
CN 2220991 Y 2/1996
(Continued)

OTHER PUBLICATIONS

Chinese Office Action dated Apr. 14, 2023, for application No. 20211119451.9.
(Continued)

*Primary Examiner* — Lars A Olson
(74) *Attorney, Agent, or Firm* — Foley & Lardner LLP

(57) ABSTRACT

An underwater propulsion system is disclosed comprising a foot board with one or more battery-powered propulsion units. A throttle control system may be enabled in the foot board such that a movement of the user's foot controls the throttle. Flattened Lithium batteries allow thin lightweight construction of the foot board. Use of trolling motors as propulsion units provides thrust advantages over pre-existing underwater scooters.

6 Claims, 34 Drawing Sheets

Related U.S. Application Data continuation of application No. 16/785,361, filed on Feb. 7, 2020, now Pat. No. 11,173,345, which is a continuation of application No. 16/115,392, filed on Aug. 28, 2018, now Pat. No. 10,576,332, which is a continuation of application No. 15/916,235, filed on Mar. 8, 2018, now Pat. No. 10,071,289.

(60) Provisional application No. 62/590,238, filed on Nov. 22, 2017, provisional application No. 62/469,129, filed on Mar. 9, 2017.

(51) Int. Cl.
*A63C 11/10* (2006.01)
*B63C 9/23* (2006.01)
*B63C 11/46* (2006.01)

(58) Field of Classification Search
CPC .. B63C 9/00; B63C 9/23; B63C 11/00; B63C 11/46
USPC ..... 440/7
See application file for complete search history.

(56) References Cited

U.S. PATENT DOCUMENTS

| | | | | |
|---|---|---|---|---|
| 4,832,630 | A | 5/1989 | Alexander et al. | |
| 5,396,860 | A | 3/1995 | Cheng | |
| 5,643,029 | A | 7/1997 | Rudofsky | |
| 5,645,460 | A | 7/1997 | Johnson | |
| 5,906,521 | A | 5/1999 | Tippmann | |
| 6,341,993 | B1 | 1/2002 | Lalli, Jr. | |
| 6,443,087 | B1 | 9/2002 | Stecker, Sr. | |
| 9,145,206 | B1 | 9/2015 | Robinson | |
| 10,071,289 | B1 | 9/2018 | Robinson | |
| 10,576,332 | B2 | 3/2020 | Robinson | |
| 11,173,345 | B2 | 11/2021 | Robinson | |
| 11,345,453 | B2 | 5/2022 | Robinson et al. | |
| 11,596,839 | B2 * | 3/2023 | Robinson | A63C 11/10 |
| 11,926,402 | B2 | 3/2024 | Robinson et al. | |
| 2005/0020155 | A1 | 1/2005 | Spagnuolo | |
| 2006/0234570 | A1 | 10/2006 | Cadorette | |
| 2007/0077831 | A1 | 4/2007 | Kuo | |
| 2011/0174209 | A1 | 7/2011 | Thiessen | |
| 2016/0068239 | A1 | 3/2016 | Railey | |
| 2016/0347428 | A1 | 12/2016 | Mahar | |

FOREIGN PATENT DOCUMENTS

| | | | |
|---|---|---|---|
| CN | 2256850 | Y | 6/1997 |
| CN | 201254282 | Y | 6/2009 |
| CN | 201470012 | U | 5/2010 |
| CN | 203047518 | U | 7/2013 |
| CN | 103776428 | A | 5/2014 |
| CN | 103935489 | A | 7/2014 |
| CN | 104432944 | A | 3/2015 |
| CN | 204317634 | U | 5/2015 |
| CN | 205220850 | U | 5/2016 |
| CN | 205256619 | U | 5/2016 |
| CN | 205293033 | U | 6/2016 |
| CN | 106110596 | A | 11/2016 |
| CN | 205854451 | U | 1/2017 |
| DE | 21 00 827 | A1 | 7/1972 |
| EP | 1 977 968 | A1 | 10/2008 |
| JP | 2005-225478 | A | 8/2005 |
| KR | 20140120626 | A | 10/2014 |
| WO | WO-2012/002682 | A2 | 1/2012 |
| WO | WO-2015/132478 | A1 | 9/2015 |

OTHER PUBLICATIONS

Australian Examination Report dated Nov. 12, 2021, from application No. 2018230432.
Brazilian Office Action dated Sep. 13, 2022, from application No. BR112019018518-6.
Chinese Office Action dated Oct. 9, 2020, from application No. 201880016653.5.
Extended European Search Report dated Nov. 30, 2020, from application No. 18763123.9.
Indian Examination Report dated Jan. 18, 2022, from application No. 201927039911.
International Preliminary Report on Patentability dated Sep. 19, 2019, from application No. PCT/US2018/021630.
International Search Report and Written Opinion dated May 29, 2018, from application No. PCT/US2018/021630.
Japanese Office Action dated Jan. 4, 2022, from application No. 2019-570348.
Non-Final Office Action dated Feb. 5, 2021, from U.S. Appl. No. 16/785,361.
Non-Final Office Action dated Jul. 12, 2019, from U.S. Appl. No. 16/115,392.
Notice of Allowance dated Nov. 7, 2022, from U.S. Appl. No. 17/518,501.
Notice of Allowance dated Oct. 23, 2019, from U.S. Appl. No. 16/115,392.
U.S. Non-Final Office Action dated Mar. 3, 2023, for U.S. Appl. No. 17/826,075.
U.S. Notice of Allowance dated Jul. 20, 2021, from U.S. Appl. No. 16/785,361.
U.S. Notice of Allowance dated May 7, 2018, from U.S. Appl. No. 15/916,235.
U.S. Notice of Allowance dated Nov. 1, 2021, from U.S. Appl. No. 16/936,134.
U.S. Notice of Allowance dated Jun. 26, 2023, for U.S. Appl. No. 17/826,075.
Brazilian Written Opinion dated Oct. 17, 2023, for application No. BR112019018518-6.
U.S. Notice of Allowance dated Nov. 2, 2023, for U.S. Appl. No. 17/826,075.
US Notice of Allowance dated Apr. 16, 2024, for U.S. Appl. No. 18/473,968.

* cited by examiner

UNDERWATER PROPULSION DEVICE

CROSS-REFERENCE TO RELATED PATENT APPLICATIONS

This application is a Continuation Application of U.S. application Ser. No. 17/518,501, filed Nov. 3, 2021, which is a Continuation Application of U.S. application Ser. No. 16/785,361, filed Feb. 7, 2020, now U.S. Pat. No. 11,173,345, granted Nov. 16, 2021, which is a Continuation Application of U.S. application Ser. No. 16/115,392, filed Aug. 28, 2018, now U.S. Pat. No. 10,576,332, granted Mar. 3, 2020, which is a Continuation Application of U.S. application Ser. No. 15/916,235, filed Mar. 8, 2018, now U.S. Pat. No. 10,071,289, granted Sep. 11, 2018, which claims priority from Provisional U.S. Application Ser. No. 62/469,129, filed Mar. 9, 2017, and Provisional U.S. Application Ser. No. 62/590,238, filed Nov. 22, 2017, which are incorporated herein by reference in their entirety.

FIELD OF INVENTION

The present invention relates to providing a battery powered propeller driven foot-mounted board for a swimmer or diver.

BACKGROUND OF THE INVENTION

Known in the art are underwater snorkel or diver hand-operated propulsion devices. For example, the Sea Doo® RS series devices are battery powered using LI-ION lightweight batteries. The handlebar controls are used to hold the device in front of the diver. The unit has a neutral buoyancy. Squeezing two triggers with one's hands powers the unit, and releasing the triggers stops the power to the propeller. Apart from requiring hand operation, such devices tend to have minimal thrust. As used herein, pre-existing hand-held thrust units will be referred to as hand-held propulsion units or generically as "sea scooters."

There is a need in the art to devise a system for adapting existing hand-held propulsion units to be capable of being mounted to a user's back, chest, or feet.

Beyond such an adaptor system, there is a need for a stand-alone device unlike any in the prior art hand-held propulsion units that is specifically designed to be foot-mounted, to be activated by the user's feet, and to allow substantial thrust underwater.

SUMMARY OF THE INVENTION

One aspect of the present invention is to provide a kit that clamps onto a hand-held propulsion device and enables mounting to a user's chest, back, or feet.

Another aspect of the present invention is to provide a novel device specially designed to be foot-mounted. In one embodiment, the device may take the form of an underwater foot board with an integral battery and motor with one or more propellers. Another embodiment of the inventive foot-mounted propulsion unit provides for a swivel foot mount to control a cable or an electronic switch that controls the speed of the motor.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
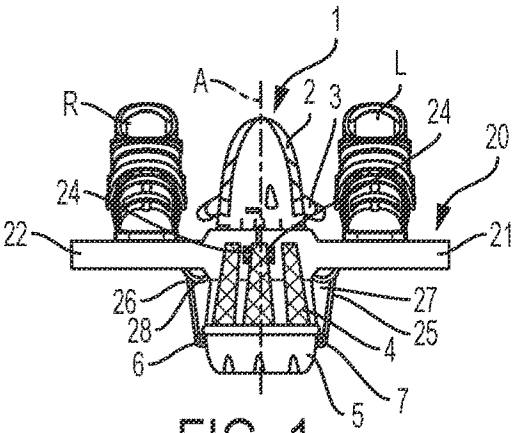
FIG. 1 is a front elevation view of a strap on foot board and a rear mounted board.

Referring to FIG. 1, the foot board 20 has a left board 21 and a right board 22. Each board 21, 22 has a central concave cutout so as to encircle the sea scooter 1 at about a midpoint of the longitudinal axis A of the sea scooter 1. A latch 24 locks the left board 21 to the right board 22 around the sea scooter 1. A left strap 25 attaches the left board 21 via a loop 27 to the hook 7. A right strap 26 attaches the night board 22.

Boots L and R are each attached to the board by an attachment structure. Such an attachment structure may comprise bindings similar to those used for a wakeboard, or water slalom skiing, or water skiing, or snowboarding, or those used for SCUBA fins, or quick dismount boots. A literal boot need not be used, as a user's bare foot may be secured by an attachment structure similar to that of a SCUBA fin, with the foot inserted into a recess or loop, and a loop secured around the heel to hold the foot in place. Where boots are used, the bindings may comprise Velcro straps, ski or snowboard-type bindings. Another embodiment is possible utilizing bindings for boots such as are used for mountain bike pedals, where a snap fitting snaps into place, but may be easily dislodged from the pedal by a deliberate motion of the user's foot. Further attachment structure are discussed below. It is advantageous for such attachment structure to allow for quick-disconnect, so that the rider may easily snap his or her foot out of the attachment structure. It is understood that as used herein, the control of the throttle of the device with the user's foot encompasses the concept of the user's foot being within a boot or the like.

Figure 2:
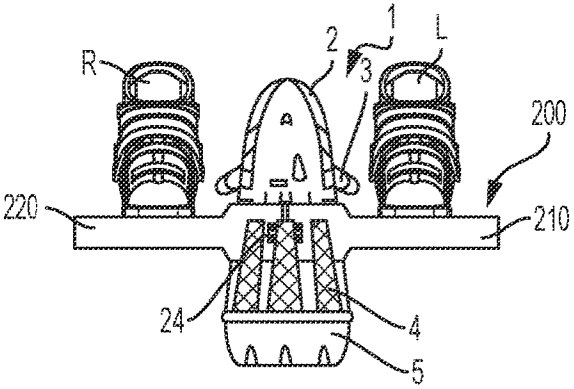
FIG. 2 is a front elevation view of a clip on foot board and a rear mounted foot board.

Referring next to FIG. 2, the foot board 200 attaches the same way as embodiment but without the straps 25, 26. For all embodiments bungee cords or straps can be added for assisting with securing the foot board to a sea scooter.

Figure 3:
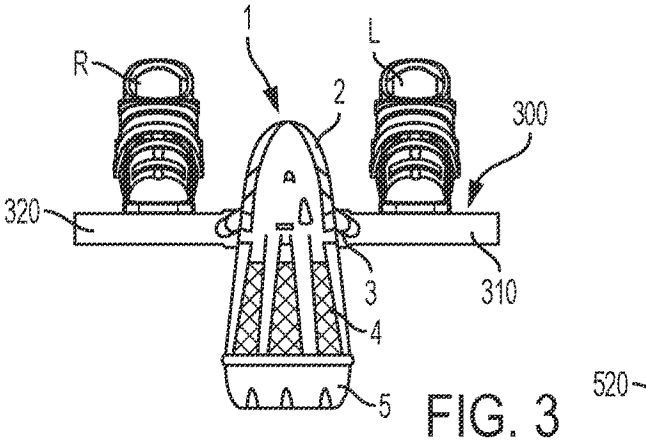
FIG. 3 is a front elevation view of a handle mounted foot board.

Referring next to FIG. 3, the handles 3 are received by suitable indents on the left board 310 and right board 320 of foot board 300.

Figure 4:
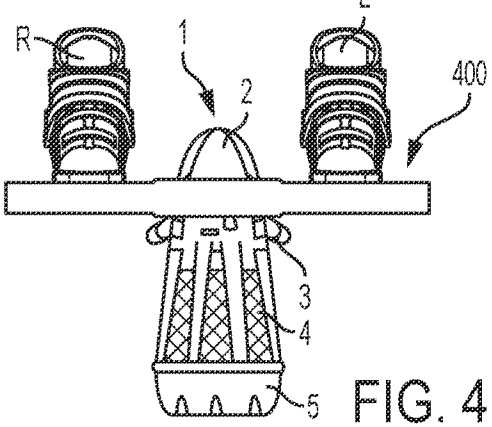
FIG. 4 is a front elevation view of a top mounted foot board.

Referring next to FIG. 4, a solid foot board 400 has a central hole to fit over the motor housing 2 above the handle 3. The taper of the motor housing 2 helps sleeve the foot board 400 to the sea scooter 1. During use, the propulsive force of sea scooter 1 will tend to keep it secure in the central hole of foot board 400. The sea scooter 1 may be further secured and stabilized to the foot board 400 by the same means previously discussed above.

Figure 5:
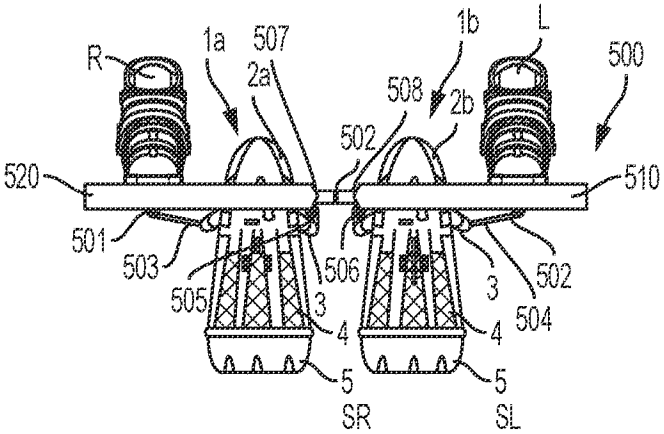
FIG. 5 is a front elevation view of a dual scooter swivel foot board.

Referring next to FIG. 5, a foot board 500 is formed with twin openings for receiving two sea scooters 1*a* and 1*b*. A left foot board section 510 has a concave opening that fits over the sea scooter motor housing 2*b*, and a right foot board section 520 has a concave opening that fits over the sea scooter motor housing 2*a*. The left board loop 502 has a bungee cord or strap 504 attached to handle 3 of sea scooter 1*b*, as well as a loop 508 attached to opposite handle sea scooter 1*b*. Likewise, right board loop 501 has a bungee cord or strap 503 attached to the outer handle of sea scooter 1*a*, as well as a loop 505 attached to inner handle 3 of sea scooter 1*a*. The left foot board section 510 may be separated from the right foot board section 520 by a detachable connector 502, such as a latch between the two board sections. This allows the device to be disassembled for easier transport.

Figure 6:
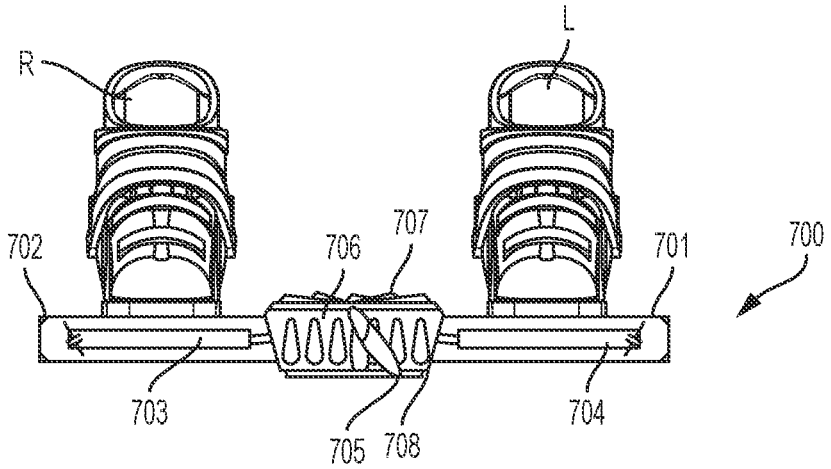
FIG. 6 is a front cross-sectional view of an integral battery powered foot board.
Figure 7:
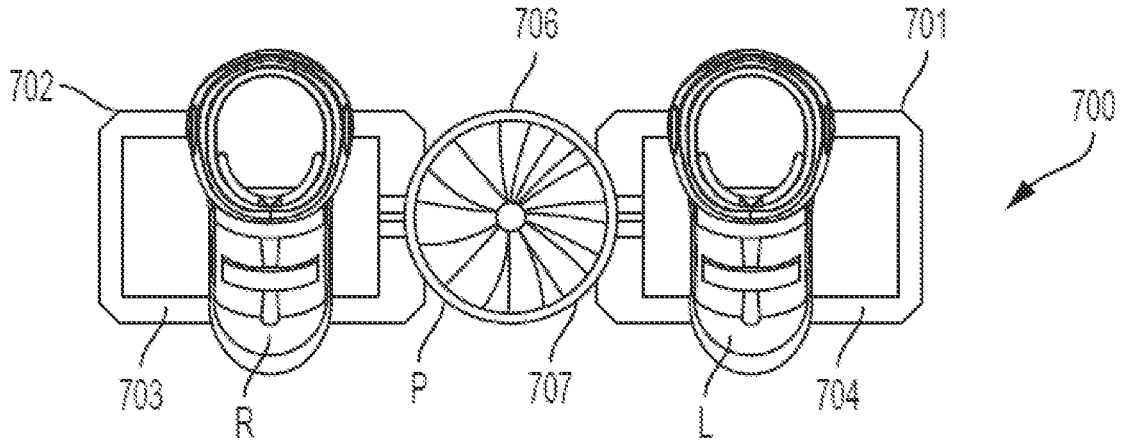
FIG. 7 is a top plan view of the FIG. 6 embodiment.

Referring next to FIG. 6, a self-contained battery foot board 700 has a left board 701 and right board 702 integrated with the housing 706 of a water propulsion unit 705, which may comprise a motorized electric propeller powered by lightweight Lithium batteries 703 and 704 sealed watertight within board 700. Water enters into port 707 of the water propulsion unit 705, and is discharged via a propeller from lower port 708. FIG. 7 is an overhead view of the embodiment in FIG. 6. As will be discussed herein, in an embodiment of the device, the propulsion unit can be a trolling motor, as set forth herein, which typically consists of a main torpedo shaped body with a propeller.

Figure 8:
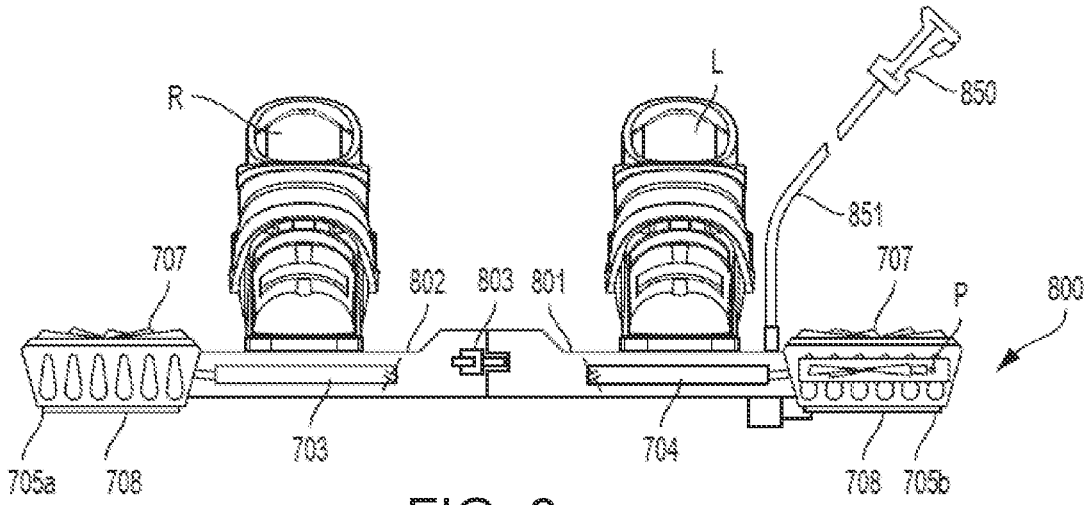
FIG. 8 is a front cross-sectional view of a dual motor integral battery powered foot board.

In FIG. 8, a different embodiment is shown in which foot board 800 is separable into left and right halves 801 and 802, each with its own separate battery-powered propulsion unit 705*a* and 705*b*. As used herein, the term "half" does not literally require that the board be split evenly, and it should be understood that separating the board into two portions of unequal width is encompassed herein so long as the board is otherwise able to support a foot on each of the separate portions. As used herein, the term "portion" of a foot board may be used interchangeably with "half" or "halves" of the foot board.

Here again, slim-profile Lithium ion batteries 703 and 704 are watertight sealed within the board, with sealed electrical leads extending out to the motors of the propulsion units. The user can lock the left to the right board using locking latch 803, but in a preferred embodiment, latch 803 allows the left and right halves of board 800 to swivel with respect to one another, such that the user can tip one foot forward while rocking the other backwards, allowing for more versatile directional control when the device is in use. Such a latch might comprise an elastic connection—such as an elastic strap or spring—that allows the halves of board 800 to swivel, while also biasing them to return to a neutral position.

A secure lateral connection between halves 801 and 802 can be aided by a male rod projecting outward along the central axis of the board 800 from one of the halves, wherein the rod is configured to mate into a hole on the corresponding side of the other half of the board, thereby allowing one half of board 800 to twist relative to the other half about an axis passing through the center of the rod.

Figure 9:
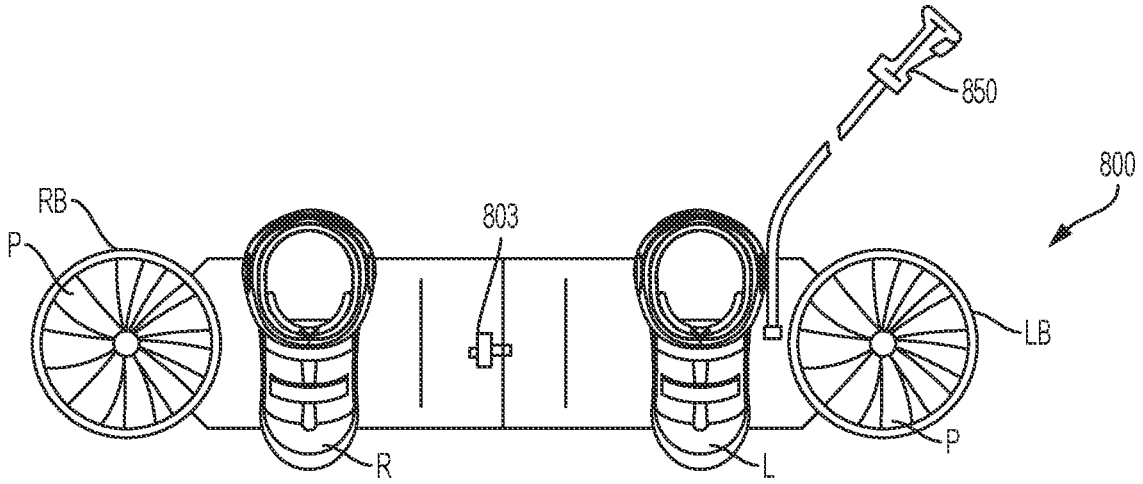
FIG. 9 is a top plan view of the FIG. 8 embodiment.

A throttle controller 850 for the propulsion units could be wireless or with a wire 851 as shown. A single controller 850 could be configured with separate throttle controls for the propulsion units 705*a* and 705*b*, or each propulsion unit could be paired with its own separate throttle controller. Usually, both units 705*a* and 705*b* would be controlled at the same speed, but allowing separate throttling will give the user more maneuverability. A microprocessor in the throttle controller could be configured to ensure that the thrust from one of the propulsion units always matches the other propulsion unit, or that the speed differential between one propulsion unit and the other never exceeds a certain threshold. Allowing separate throttle control for the two propulsion units also allows one to be placed into reverse thrust while the other provides forward thrust, thereby allowing the user to spin more quickly. And allowing the user to vary the relative thrust force of the two propulsion units will allow for greater control and maneuverability. FIG. 9 is a top plan view of the embodiment shown in FIG. 8.

Figure 10:
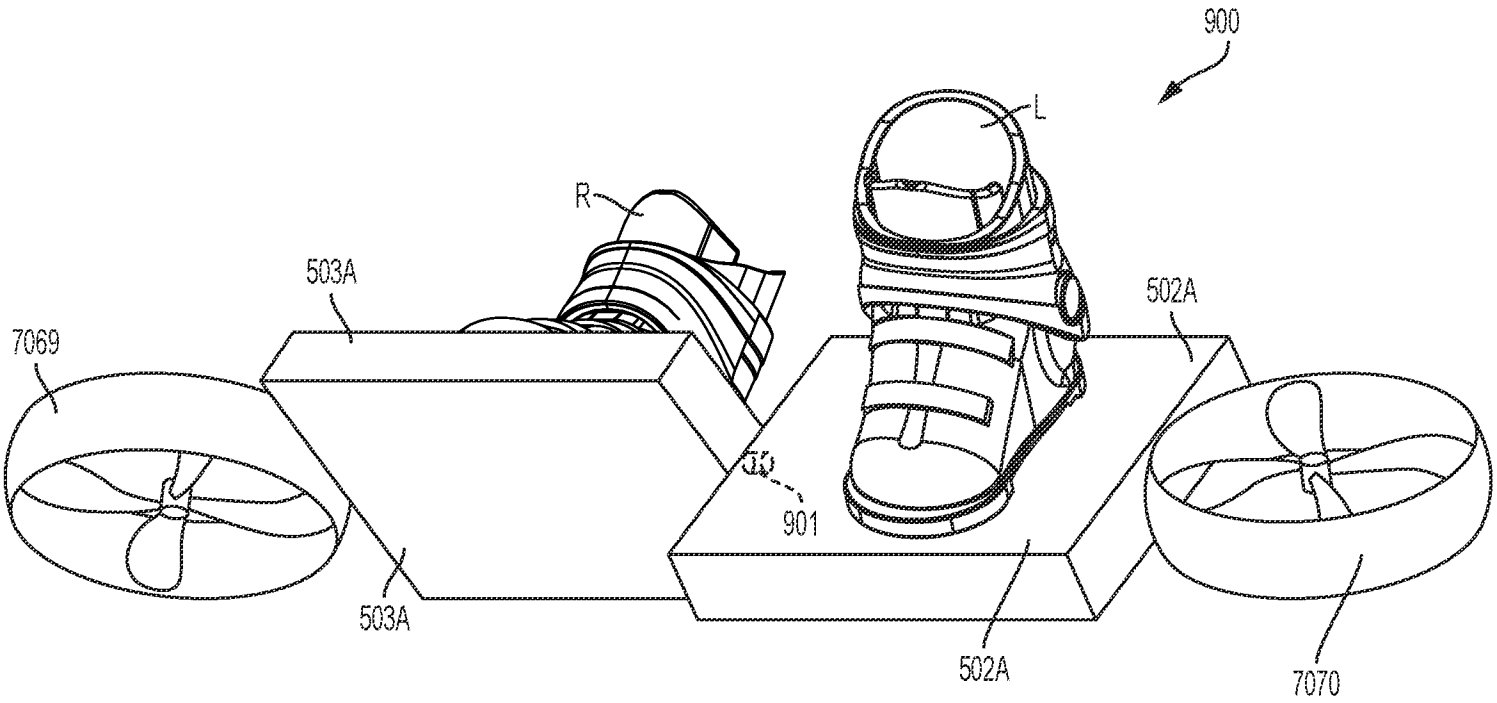
FIG. 10 is a front perspective view of embodiment of the device.

Referring next to FIG. 10, a foot board 900 is shown with individually pivotable feet as discussed with respect to the embodiment in FIG. 8. A linkage 901 is provided as a connector having a rotary bearing that enables rotation about an axis running through the board halves. Note that although the foot board has been shown in this and the preceding figures as having a flat surface, it is also possible to hydrodynamically shape the foot board surface to be curved to decrease water resistance when the device is in operation. For example, the edges of the foot board can be made to curve downward away from the boot mounts to allow water to more easily flow around them.

Although the propulsion units depicted in FIGS. 6-10 have been shown as flat propeller units, it has been found that the device works very well with trolling motors used as the propulsion units. A trolling motor is an underwater electric propeller that is typically attached to a long rod and used as a makeshift outboard motor on small one- or two-man watercraft. A good trolling motor can generate 50 lbs or greater of thrust force, and there are models that are even substantially more powerful than that, supplying well over 100 lbs of force. Trolling motors are thus notably more powerful than prior art hand-held propulsion unit motor. As used herein, the term "trolling motor" is not limited literally to motors marketed as trolling motors, but to any electric propeller motors of similar construction or power. An example of a suitable trolling motor is a Haswing Protruar 24v, 2.0 hp motor, which is rated at 110 lbs of thrust; or a Minn Kota Saltwater Riptide, which is rated at 101 lbs of thrust; or a Newport Vessel, which is rated at 55 lbs of thrust.

A commercially available trolling motor such as those just identified may need retrofitting for operation at depths greater than about 30 feet. High pressure gaskets are known in the art of, for example, sealed underwater video-camera equipment, that are more suitable for operation at significant depth than the gaskets found on ordinary commercial trolling motors available as of the time of this writing. Many of such gaskets are often made of polyurethane material or similar polymer. Water-tight sealing for deep diving can also be achieved by designing the motor casing to have multiple rows of gaskets at the sealing joints. The negative space within the motor casing chamber may also be filled with oil to prevent water intrusion during deep diving, with inlet and outlet valves for draining and replacing the oil. High-quality mineral oil is non-electrically conductive and will work for this application, though professional grade transformer oil (as is used in commercial electrical transformers) may be preferable.

Figure 11:
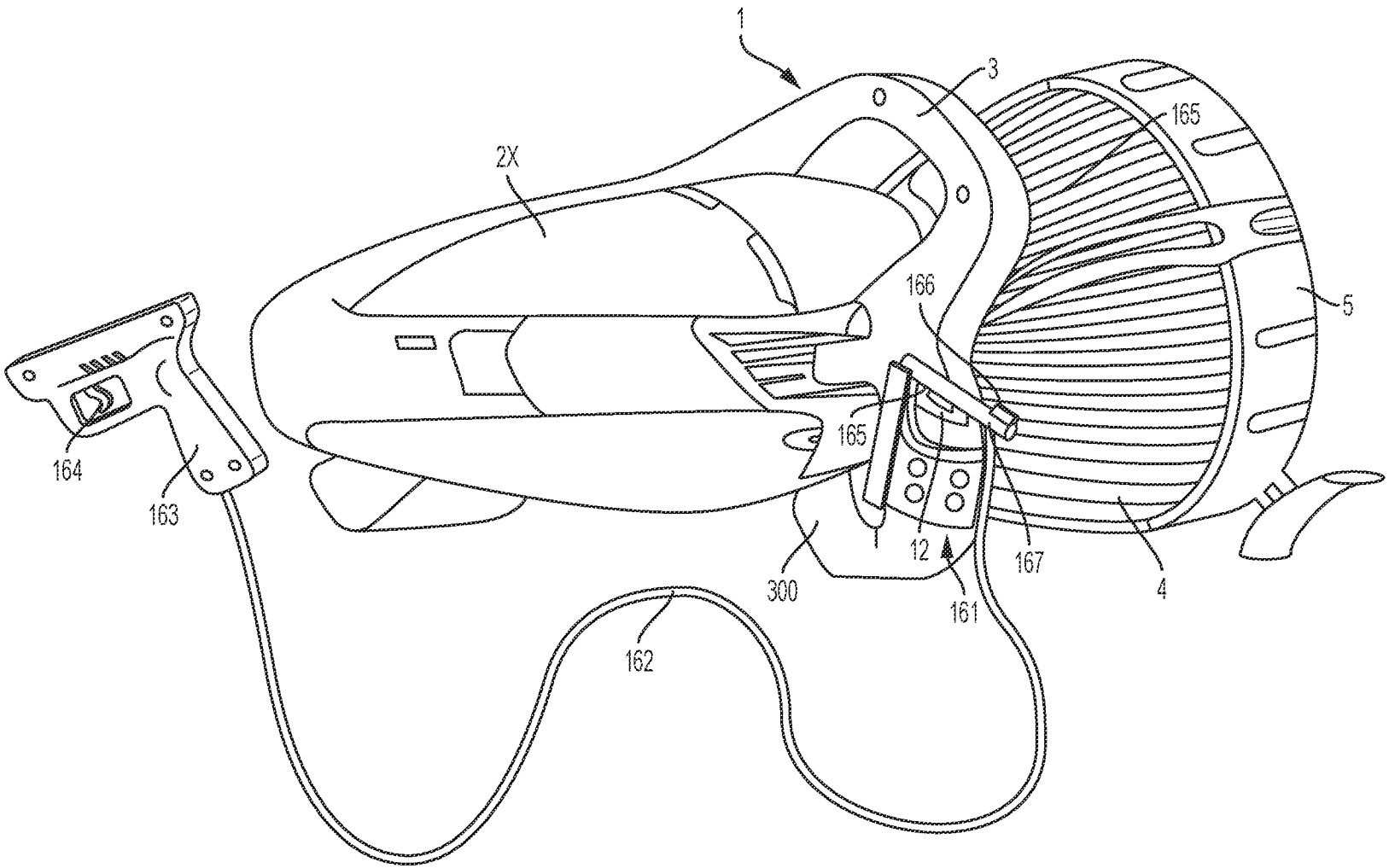
FIG. 11 is a side perspective view of a sea scooter fitted with a cable driven throttle button lever.

Referring next to FIG. 11 the prior art sea scooter 1 has a handle 3 and 300 with a scooter throttle button 12 on each 20 side. A throttle lever assembly 161 may be fastened to handle 300 with a second throttle assembly 161 fastened to handle 3. This embodiment has a cable 162 within a sheath that is connected to hand controller 163 that has an activate trigger 164. Trigger 164 pulls the head 166 of control cable 167 so as to tilt the lever 165 against the scooter throttle 12.

Figure 12:
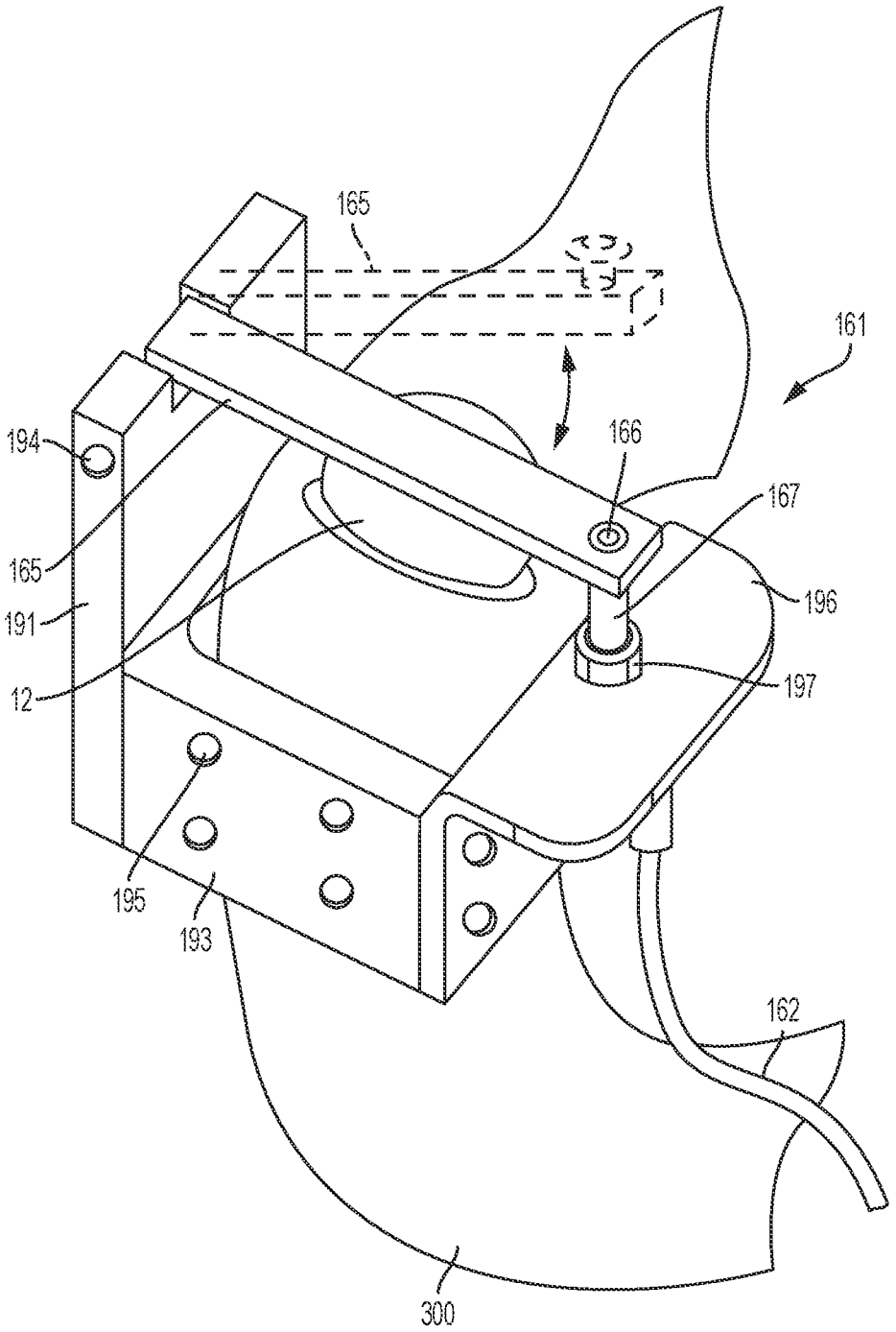
FIG. 12 is a perspective view of the throttle button lever assembly mounted to a sea scooter hand grip.
Figure 13B:
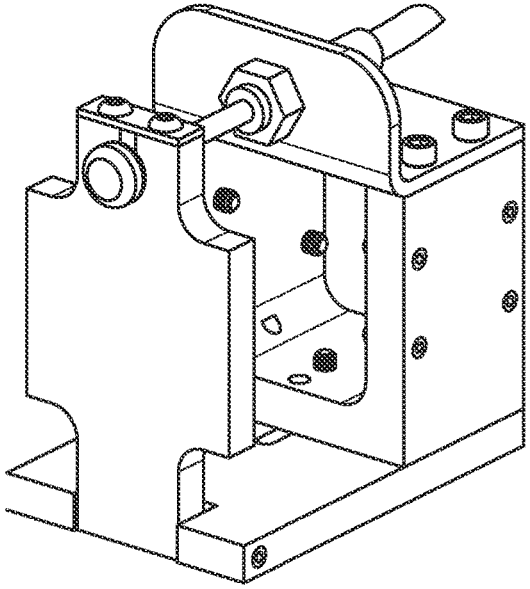
FIG. 13B is a perspective view of the throttle button lever assembly.
Figure 13A:
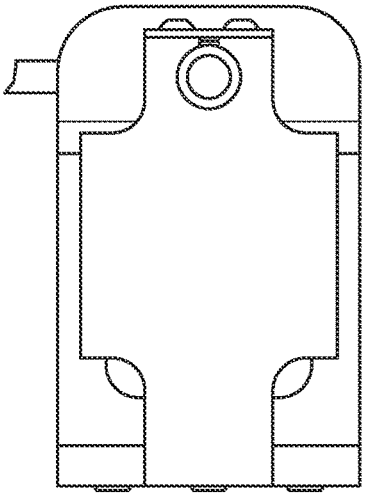
FIG. 13A is a side view of the throttle button lever assembly.
Figure 13E:
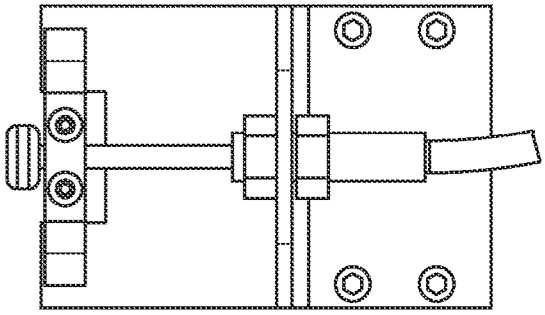
FIG. 13E is a top view of the throttle button lever assembly.
Figure 13D:
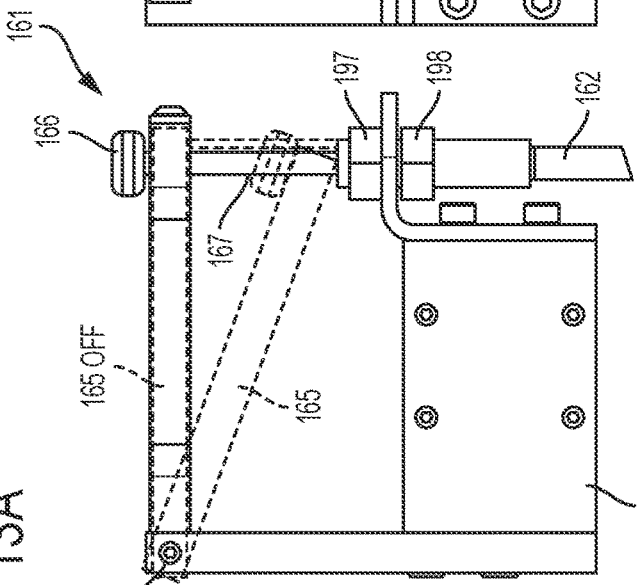
FIG. 13D is a side cross-sectional view of the throttle button lever assembly.
Figure 13C:
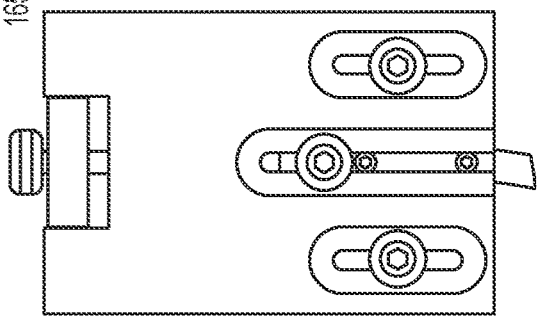
FIG. 13C is a side view of the throttle button lever assembly.
Figure 14:
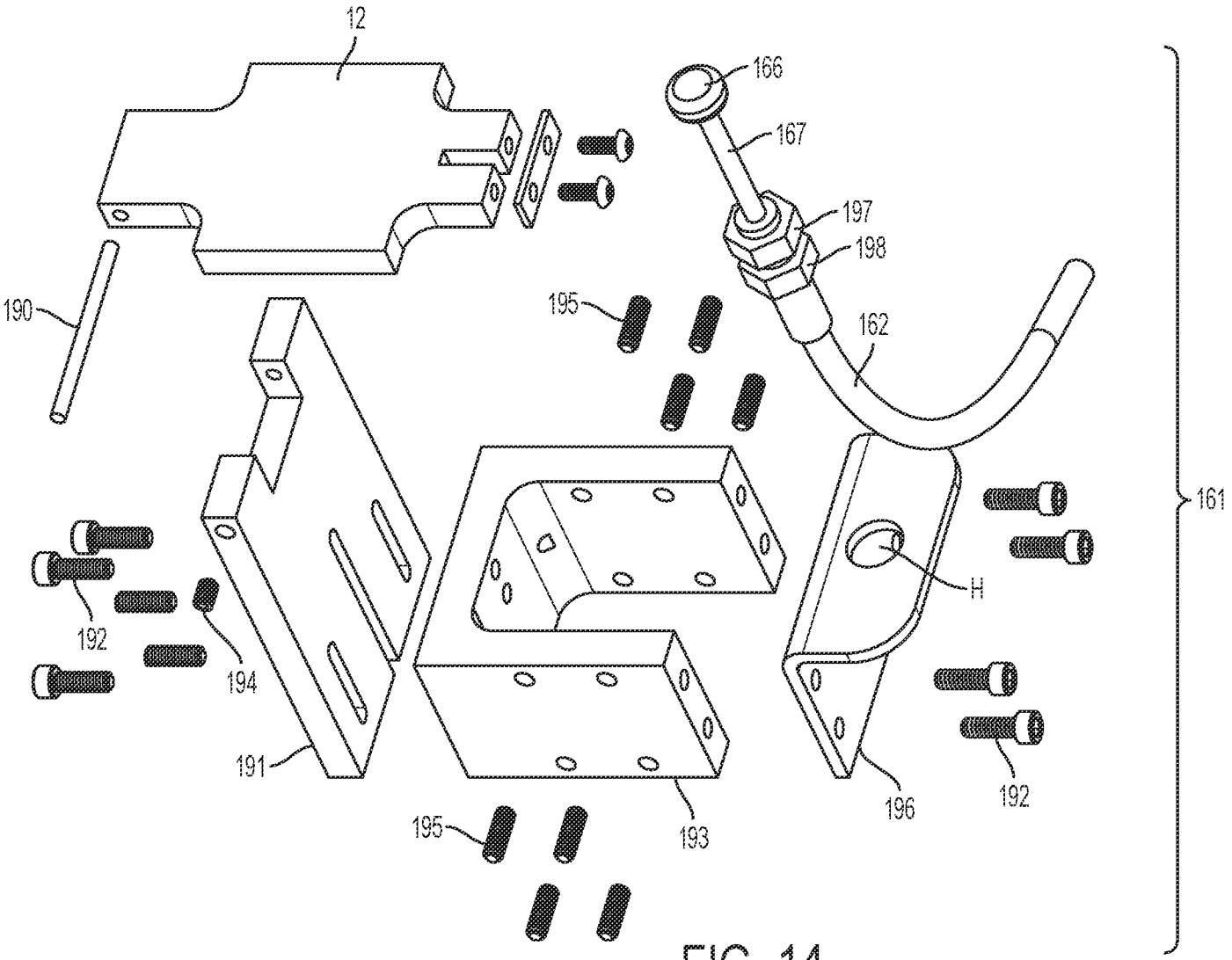
FIG. 14 is an exploded view of the throttle button lever assembly.

FIG. 12 shows a close-up of an example of a throttle lever assembly. When the cable 162 is pulled, it causes lever 165 to push down on throttle button 12. FIGS. 13A, 13B, 13C, 13D, and 13E, show the throttle assembly 161 on its own from various angles. In FIG. 13D, the lever 165 is shown in dots in the neutral OFF position. The lever 165 hinges around hinge shaft 165*a* which is mounted to back 191. The back 191 has bolts 192 fastening it to the block 193. Set screw 194 secures the hinge shaft 190. As can be seen, cable 162 terminates in end 166, and when cable 16 is pulled, end 166 in turn pulls down on lever 165, which then presses down on the throttle trigger. FIG. 14 shows an exploded view of an example throttle lever assembly.

Figure 15:
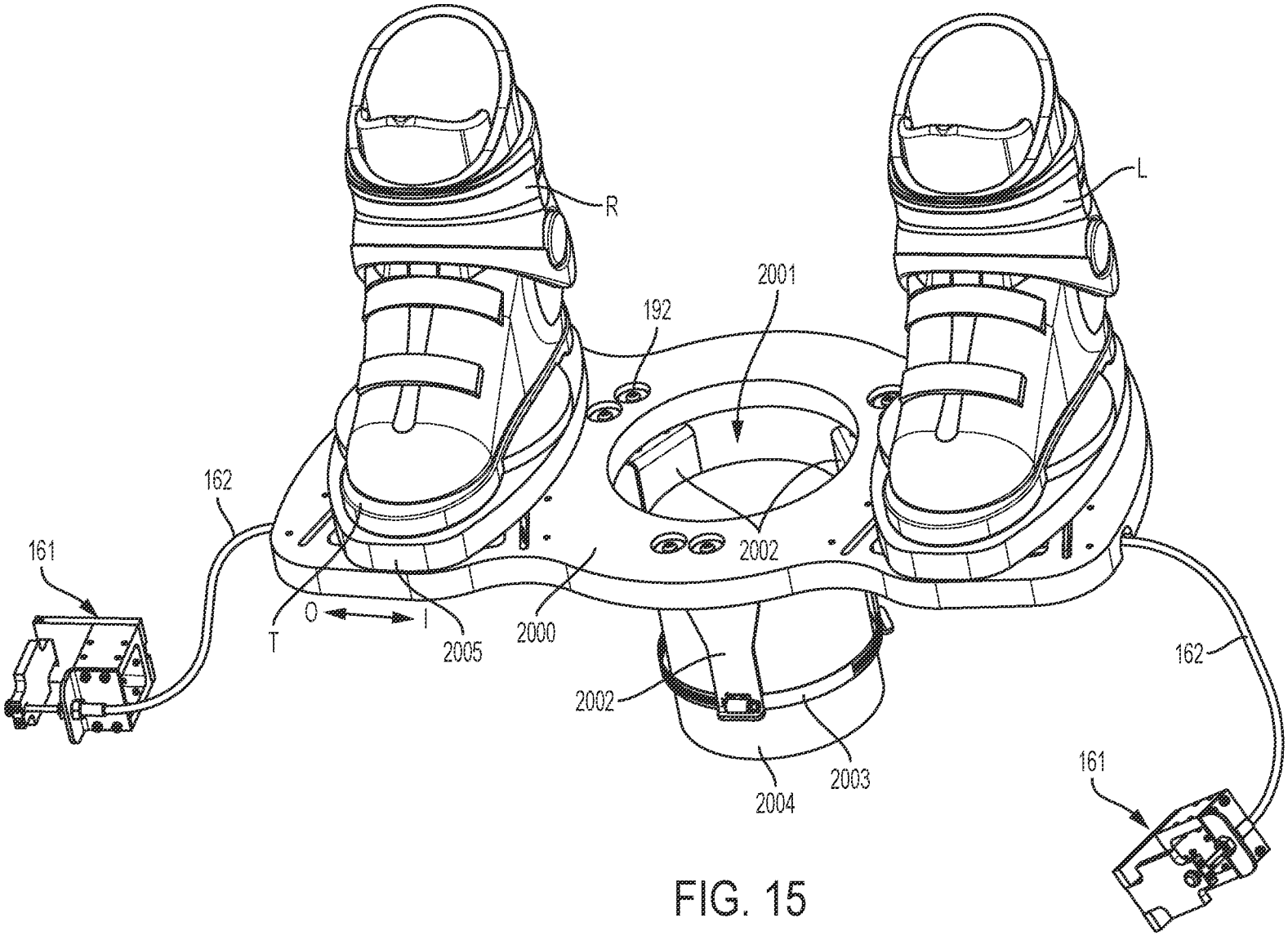
FIG. 15 is a front perspective view of a foot controlled foot board.

Referring next to FIG. 15, a scooter board 2000 has a mounting hole 2001 to receive a sea scooter. Brackets 2002 secure hose clamps 2003 to lock the sea scooter in mounting hole 2001. A protective sheath 2004 may be used. A right foot plate 2005 has a heel pivot mount 2006, so it can be moved out O or in I by the toe T of the right boot R. A reverse hook up is optional where the toe is pivoted and the heel moves in and out, as will be shown in FIGS. 22 and 23. As the toe T moves in I, the cable end 166 pulls the control cable 167, and the lever 165 on the trigger assembly 161 is depressed into the scooter trigger. Thus, this embodiment enables the user to control throttle by rotating their feet on the surface of the foot board, with the sprint returns tending to bias the feet back to a neutral position.

Figure 16:
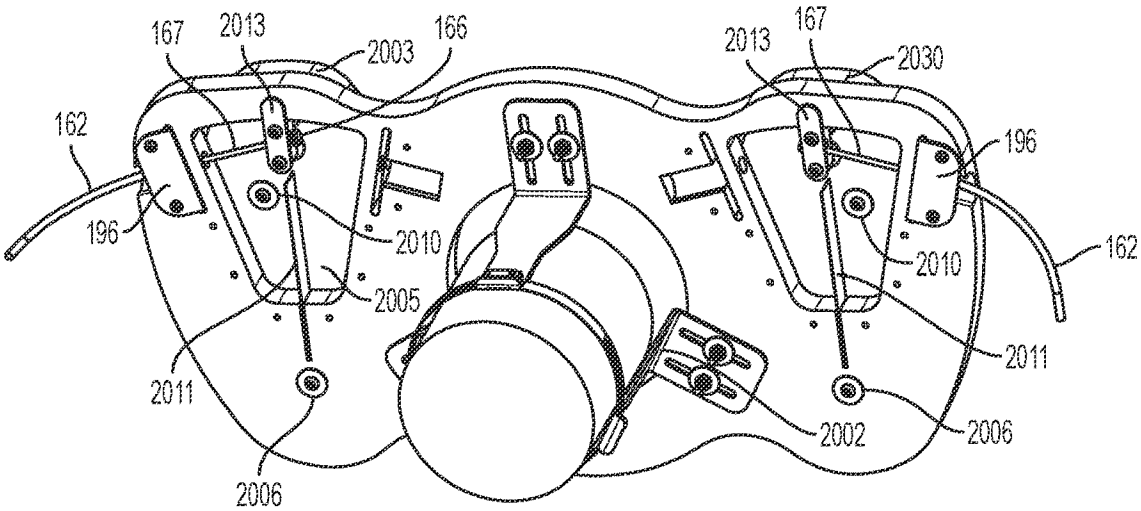
FIG. 16 is a bottom perspective view of the foot controlled foot board.
Figure 17:
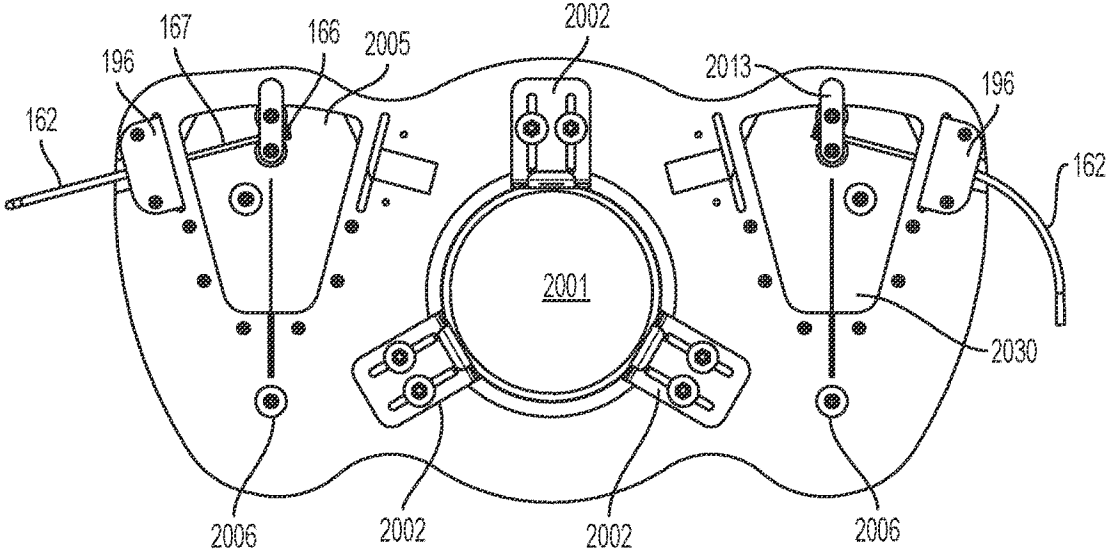
FIG. 17 is a bottom plan view of the foot controlled foot board.
Figure 18:
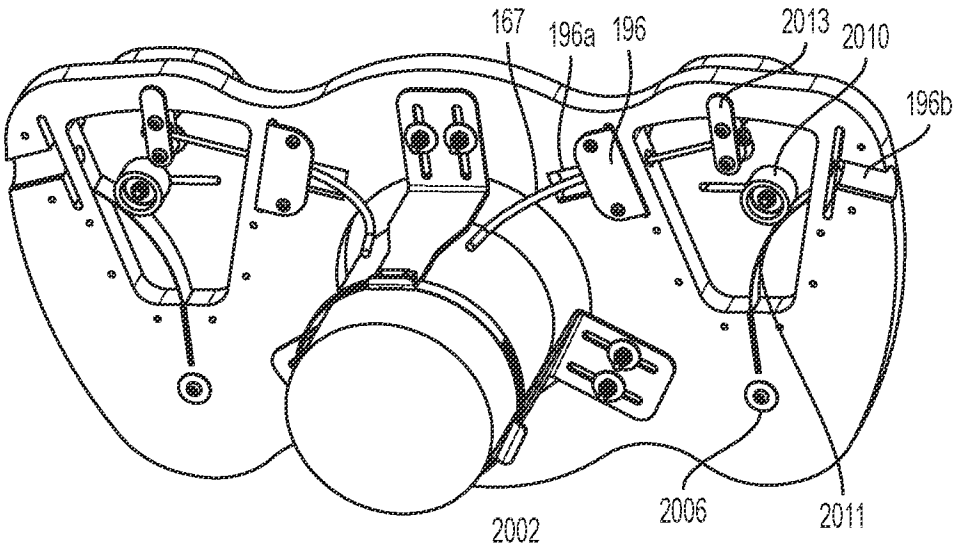
FIG. 18 is a bottom perspective view of an embodiment of the device.
Figure 19:
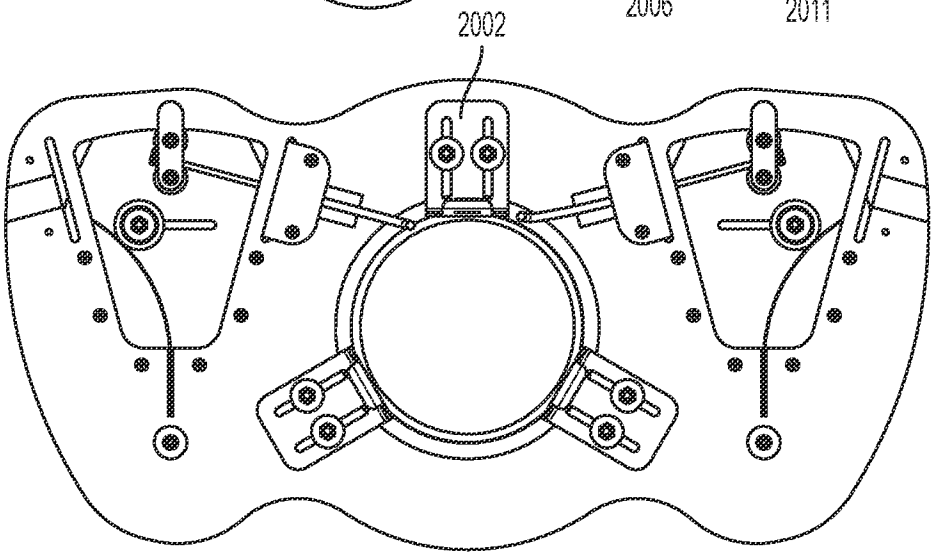
FIG. 19 is a bottom plan view of an embodiment of the device.

FIG. 16 is a bottom perspective view of the embodiment shown in FIG. 15, and FIG. 17 is a top plan view of the same embodiment. FIGS. 18 and 19 are like FIGS. 16 and 17 except with a reverse mounting of the control cables 167. As can be seen, the spring ball 2010 pushes the flat spring 2011 inward during acceleration. As can be seen, the spring 2011 returns the lever 165 to neutral when the user stops pushing in I.

Figure 20:
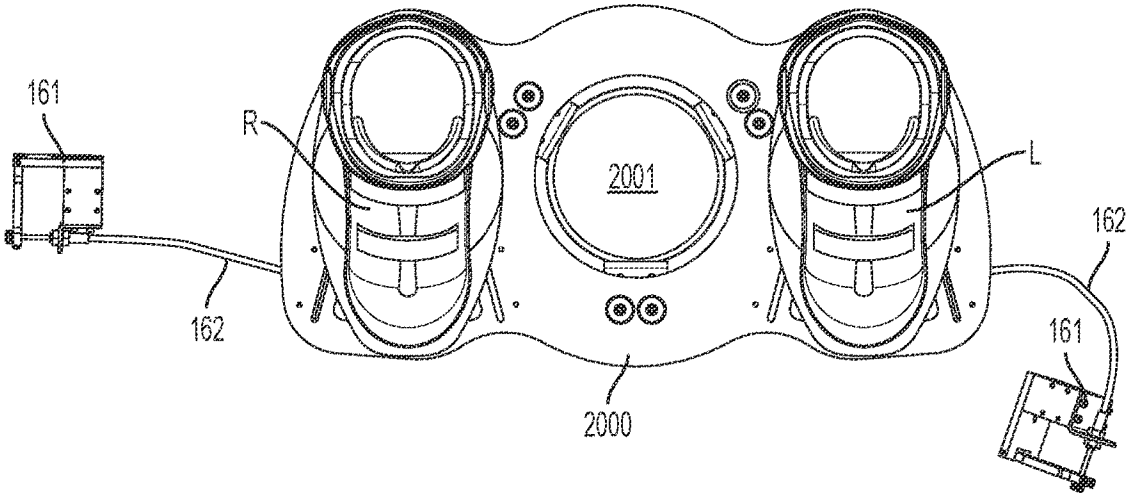
FIG. 20 is a top plan view of an embodiment of the device.
Figure 21:
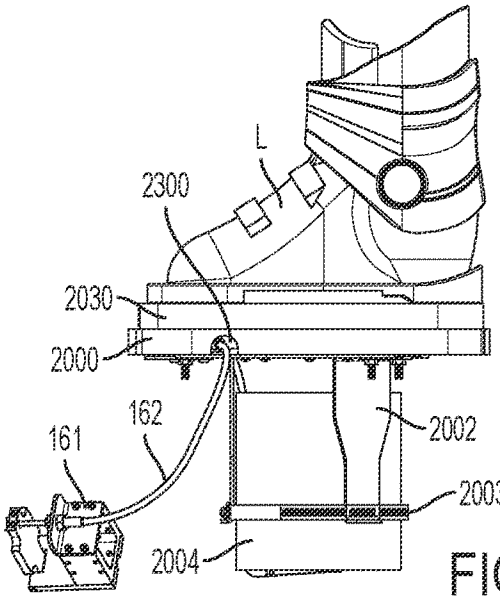
FIG. 21 is a side view of an embodiment of the device.
Figure 22:
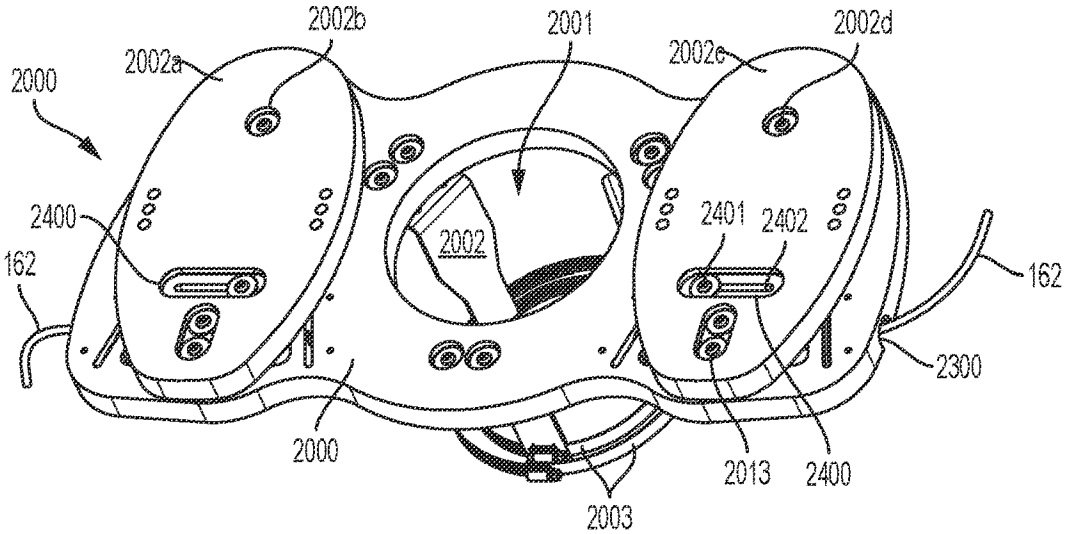
FIG. 22 is a top perspective view of the embodiment of the device.
Figure 23:
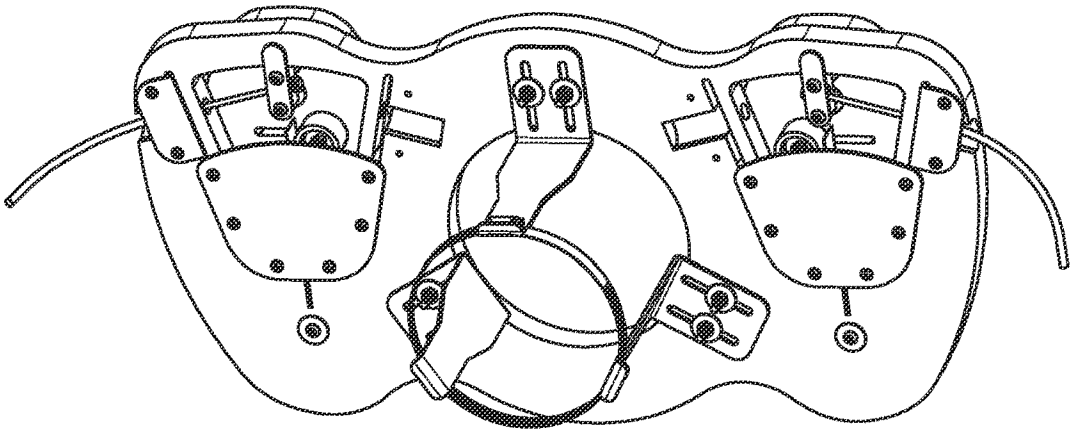
FIG. 23 is a bottom perspective view of the embodiment of the device.
Figure 24:
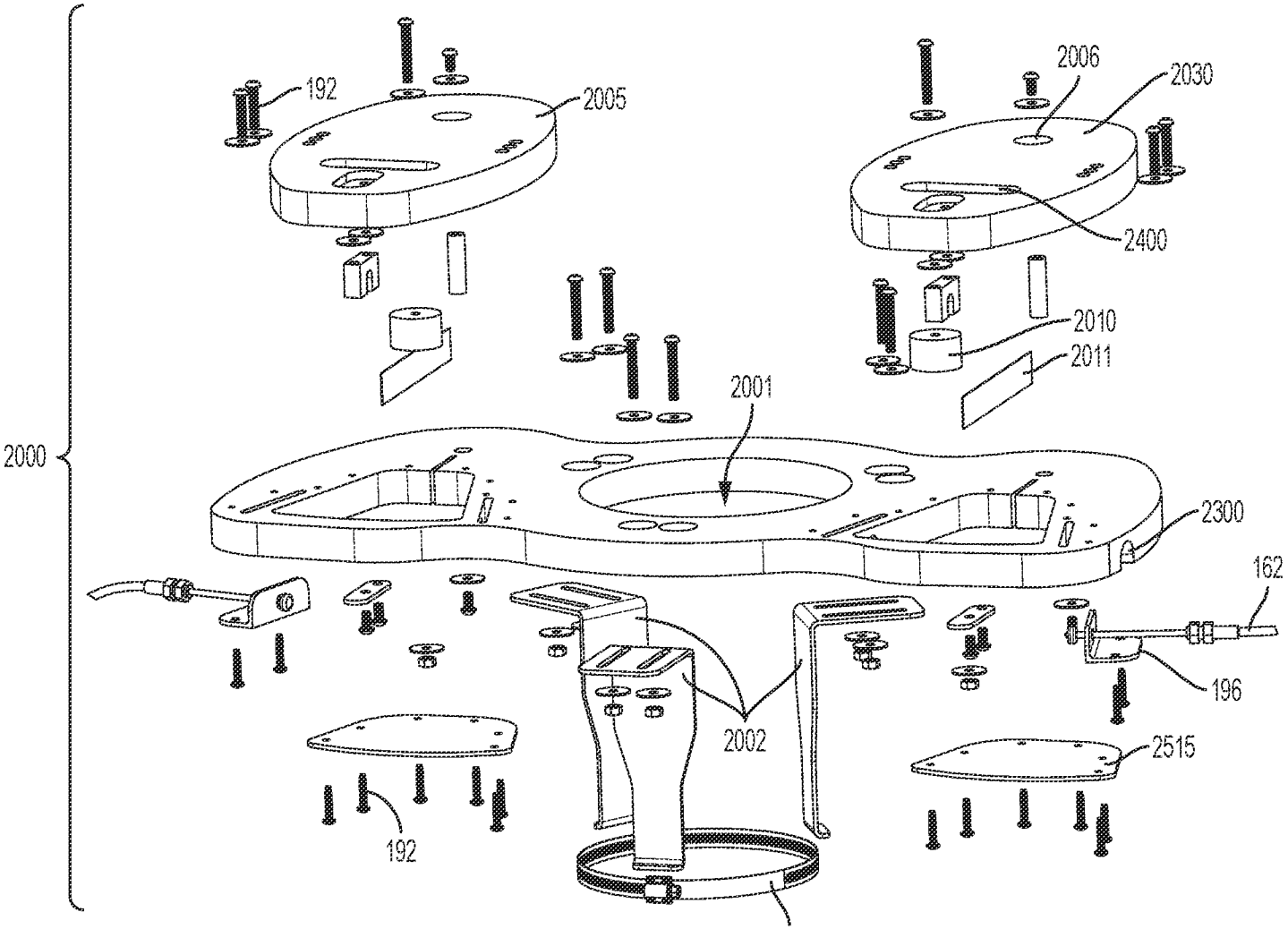
FIG. 24 is an exploded view of the embodiment of the device.
Figure 25:
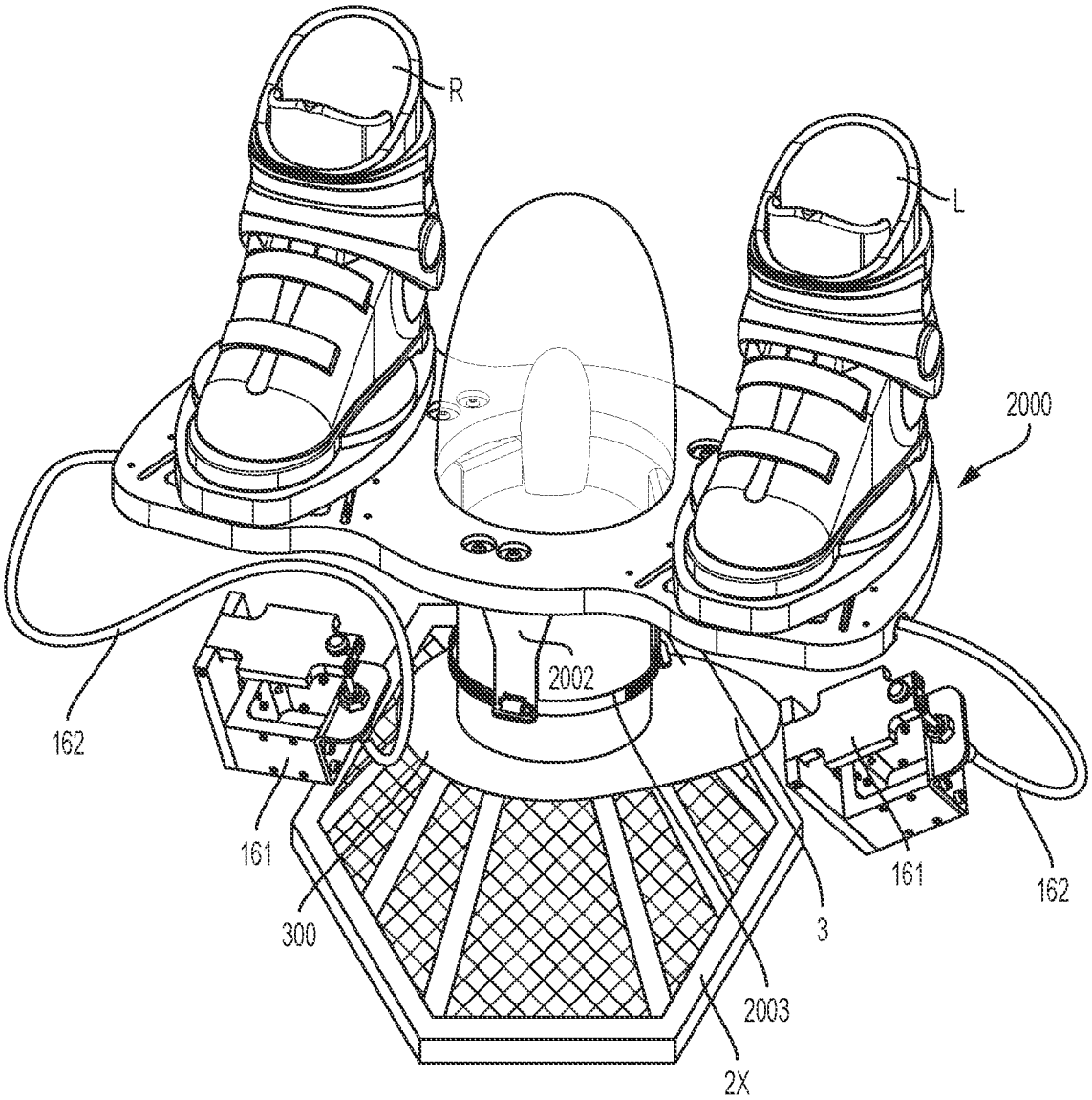
FIG. 25 is a front perspective view of the embodiment of the device mounted to a sea scooter.

Referring next to FIGS. 20 and 21, the boots L and R are mounted to their respective foot plates 2030 and 2005 by an attachment structure (as previously described in connection with to FIG. 1). A hole 2300 allows the cable 162 to exit from under the respective foot plates. FIG. 22 shows a top perspective view of the device wherein the swivels 2002*b* and 2002*d* are located at the heel. FIG. 23 shows a view of the underside of the device from FIG. 22. FIG. 24 is an exploded view of the device, and FIG. 25 shows the device with a sea scooter inserted.

Figure 26:
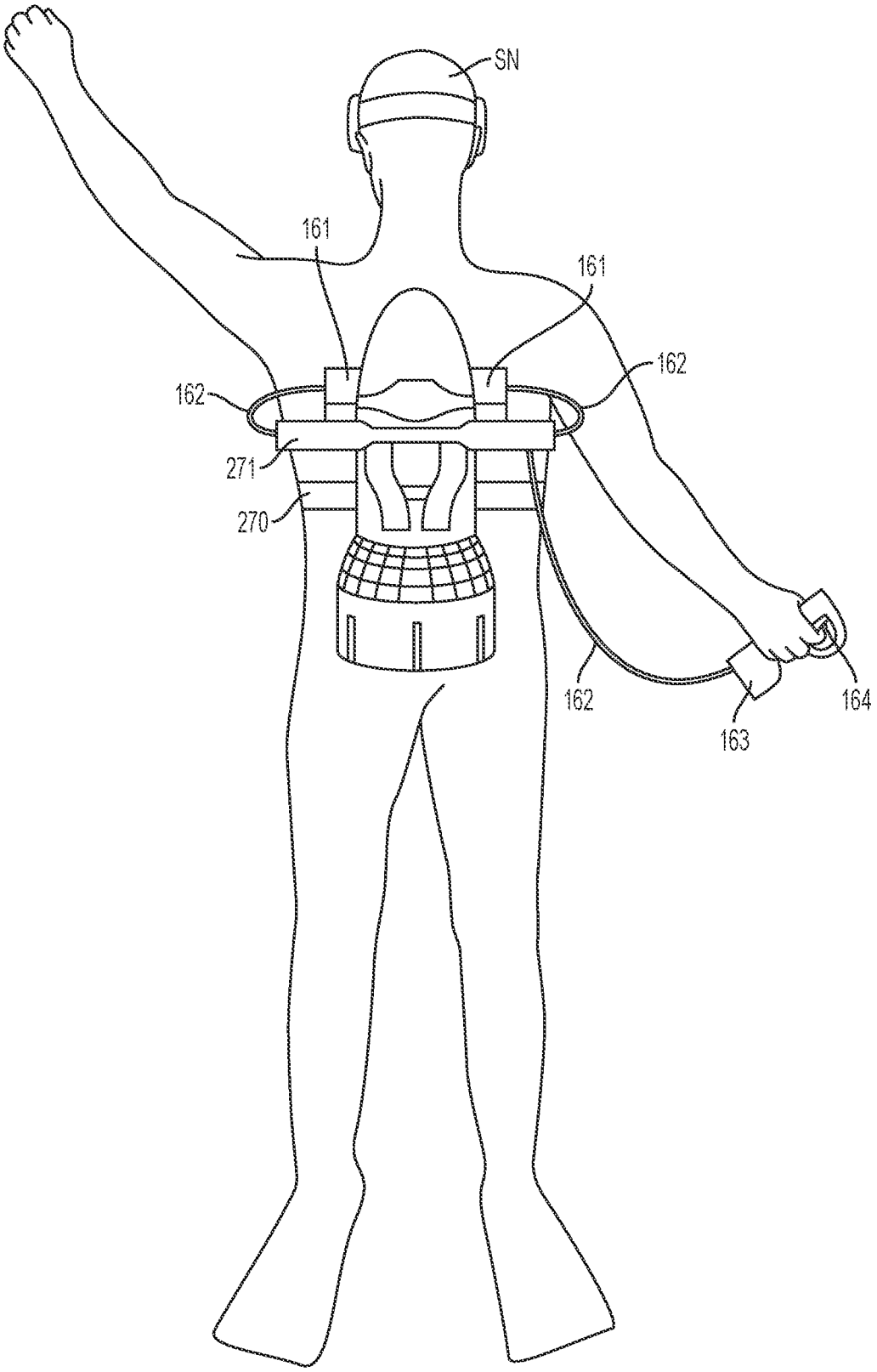
FIG. 26 is a top plan view of a back mounted sea scooter.
Figure 27:
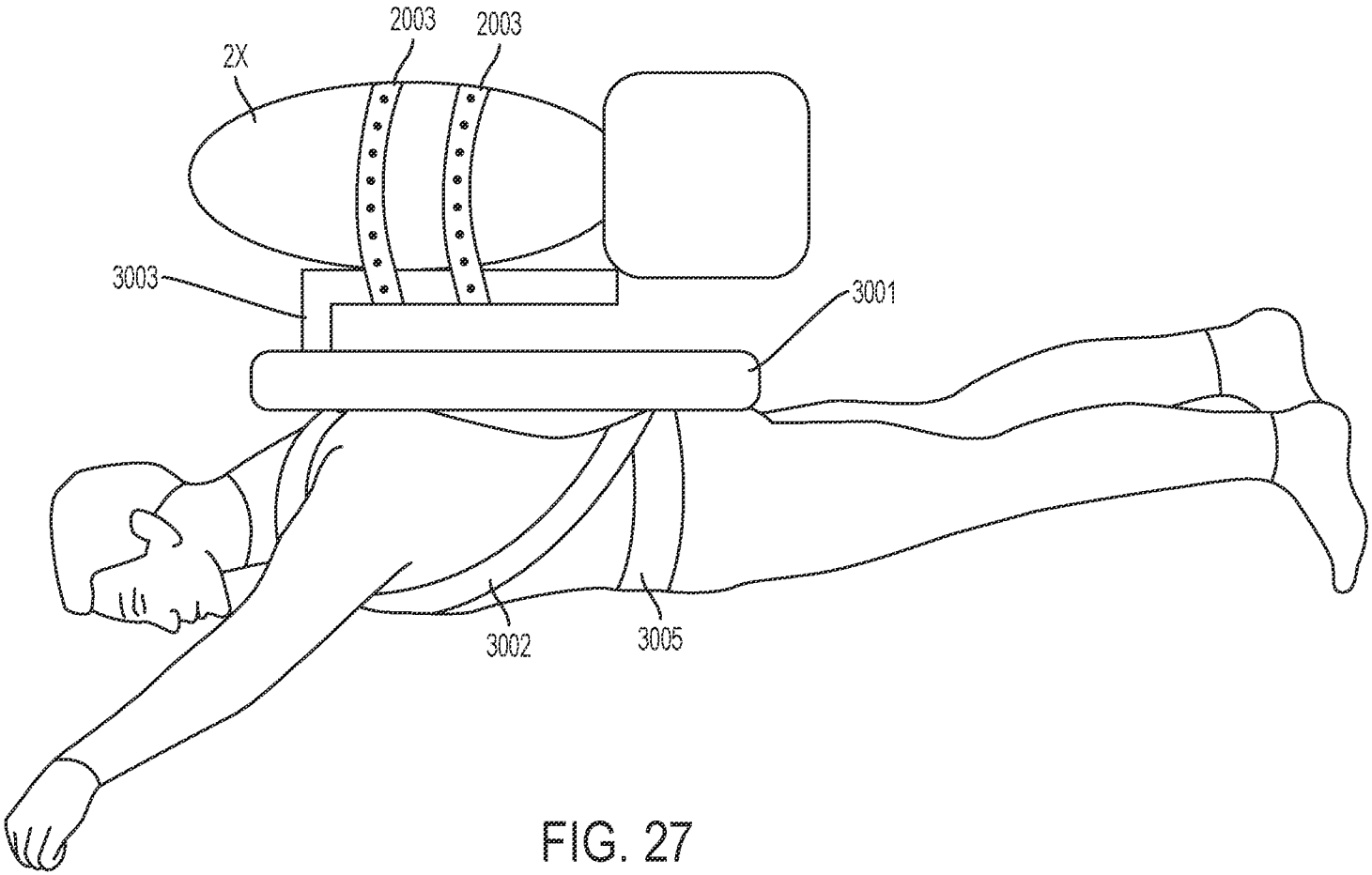
FIG. 27 is a side perspective view of an L bracket back embodiment.
Figure 28:
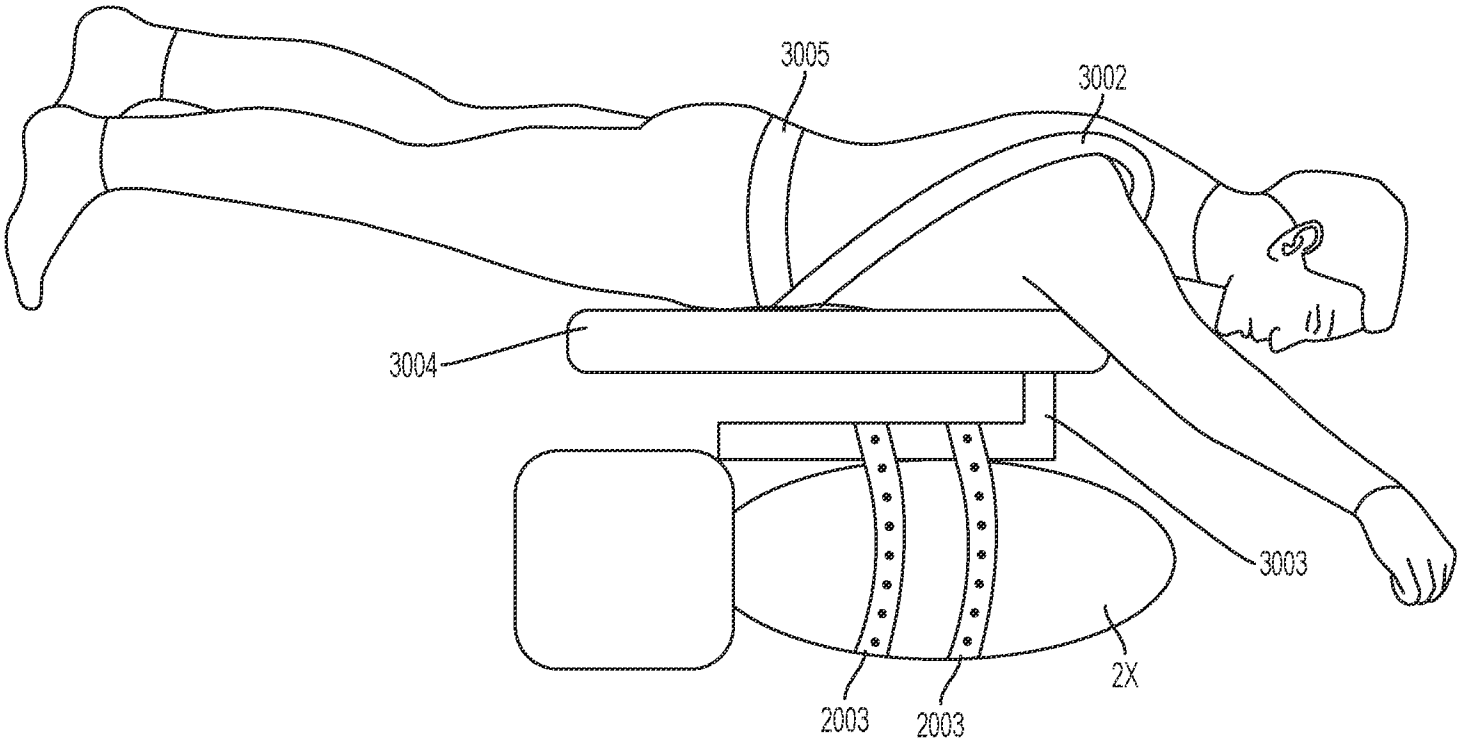
FIG. 28 is side elevation view of an L bracket chest embodiment.
Figure 29:
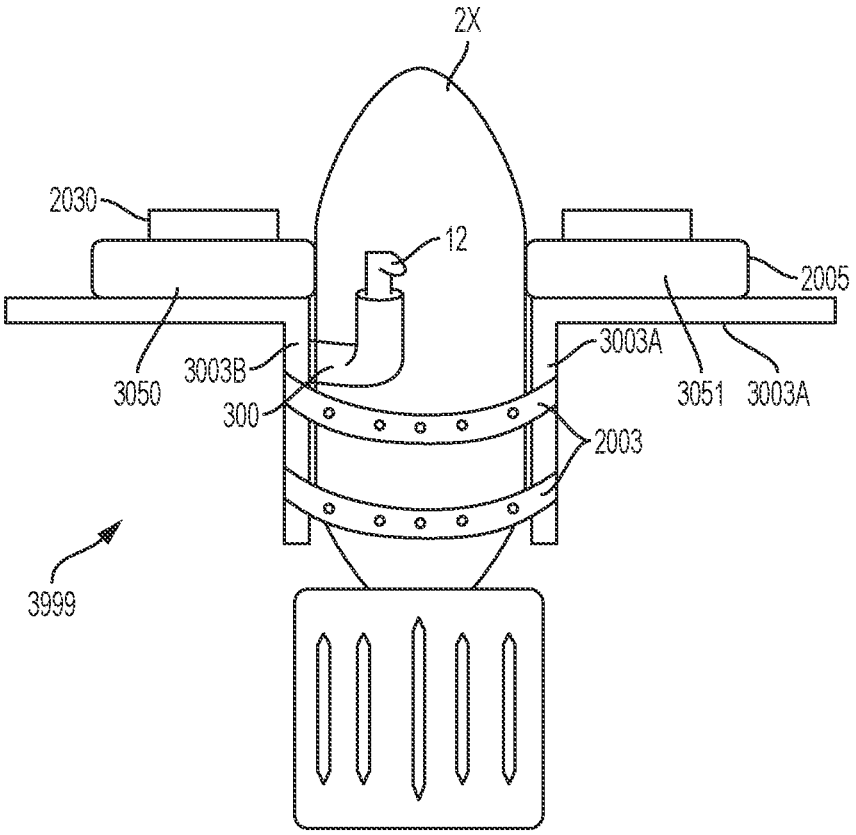
FIG. 29 is a front view of a dual L bracket foot board.
Figure 30:
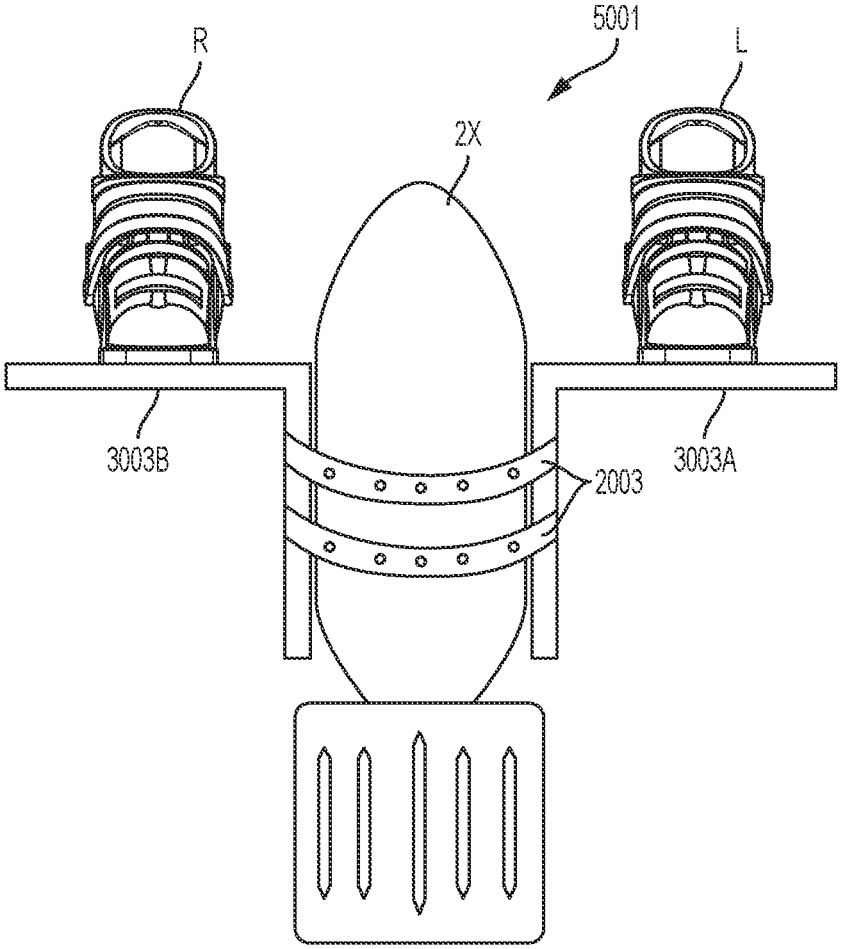
FIG. 30 is a front view of a dual L bracket foot board.

FIGS. 26, 27 and 28 demonstrate how a sea scooter rigged with a wired or wireless throttle controller may be mounded to an L-bracket 3003 attached to a body plate 3001 or 3004 with which has shoulder straps 3002 for a swimmer. Straps 2003 secure the sea scooter to the L bracket 3003. This L-bracket configuration provides a versatile mounting means. FIG. 30 shows a foot board embodiment 5001 that uses L-brackets 3003A and 3003B and straps 2003 to secure a left and right foot board with boots L and R.

Figure 31:
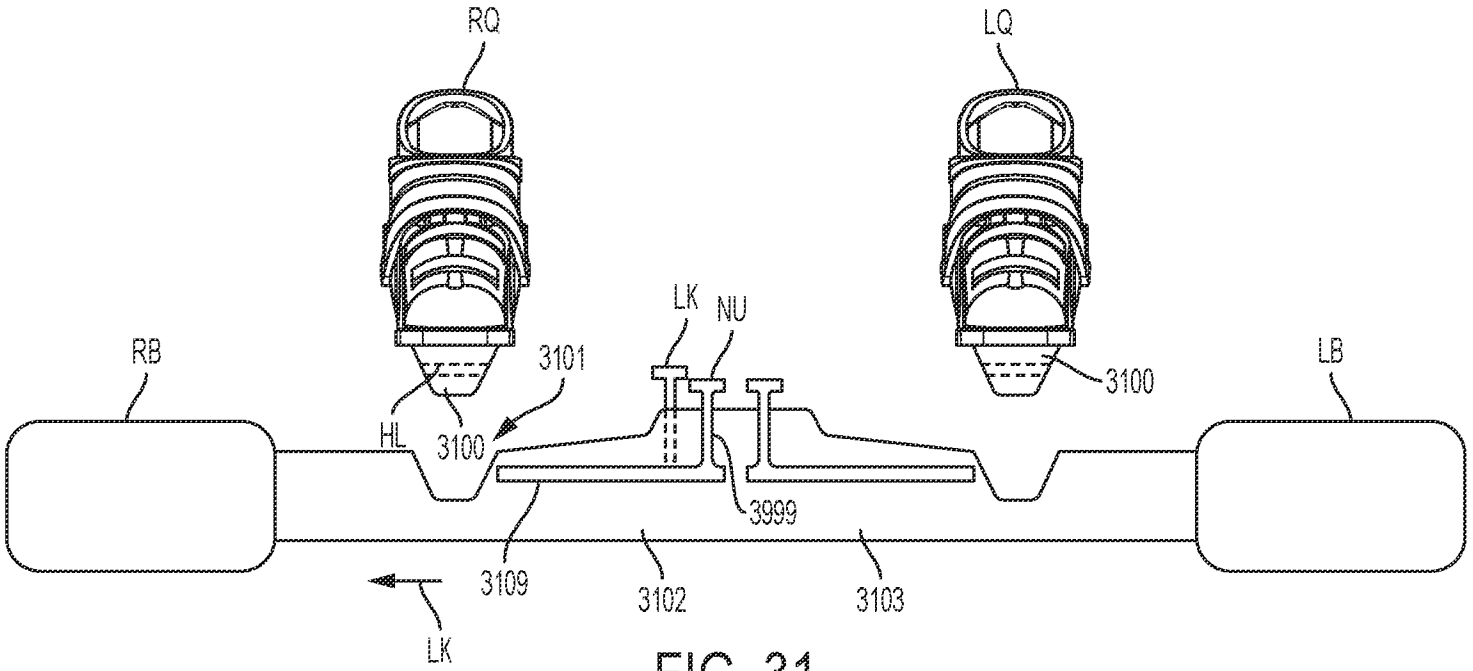
FIG. 31 is a front elevation view of a quick disconnect boot embodiment.
Figure 32:
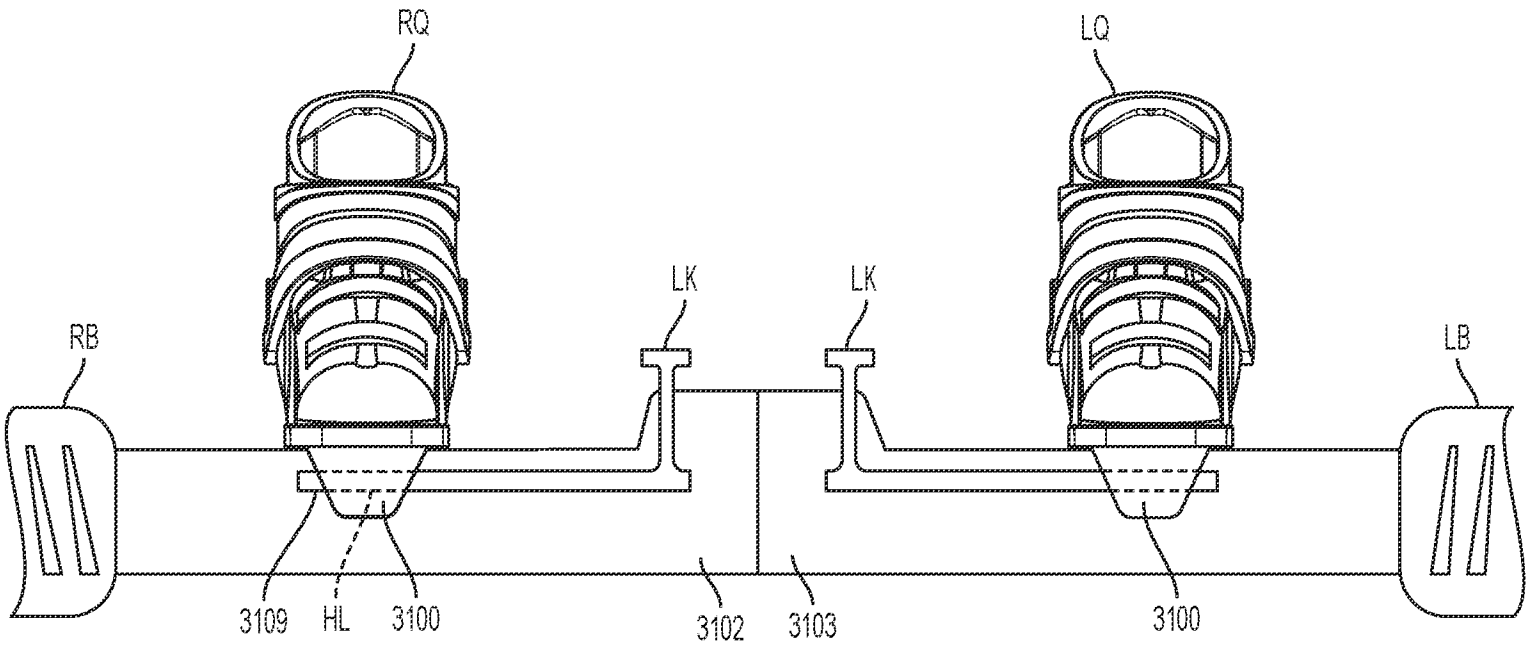
FIG. 32 is a front cross-sectional view of a quick disconnect boot locked into place.

Referring next to FIGS. 31, quick disconnect boots RQ and LQ have a bottom flange 3100 that fits into the groove 3101 on respective left and right foot boards 3102 and 3103. When the sliding lever arm 3999 is in the neutral position NU, the flange 3100 can be inserted into the groove 3101. When the lever arm 3999 is moved to the lock position LK shown in dots and the movement for which is shown by arrow LK, the rod 3109 has passed through a hole HL in flange 3100, locking the boots onto respective boards 3102 and 3103. FIG. 32 shows the arms in the locked position. The boots may be released by pulling the arm 3999 back to the neutral position.

Figure 33:
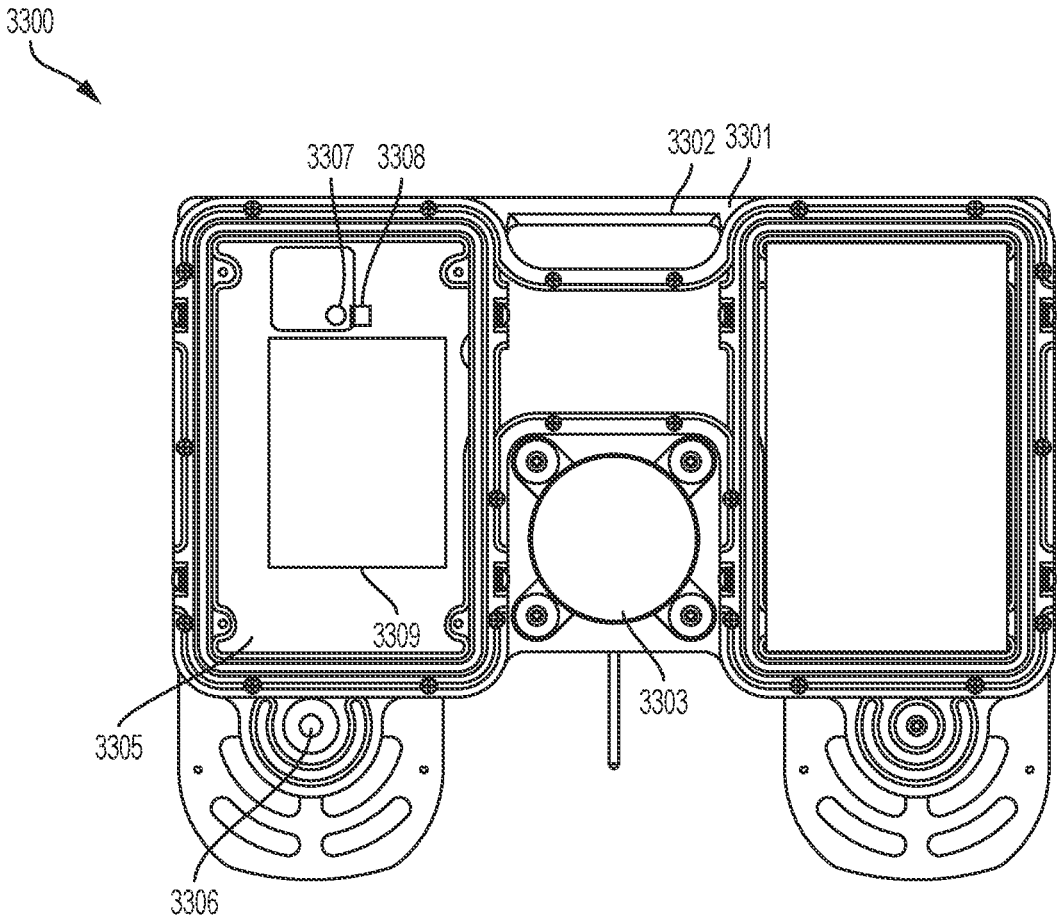
FIG. 33 is a bottom plan view of a foot pedal magnet based speed control embodiment.
Figure 34:
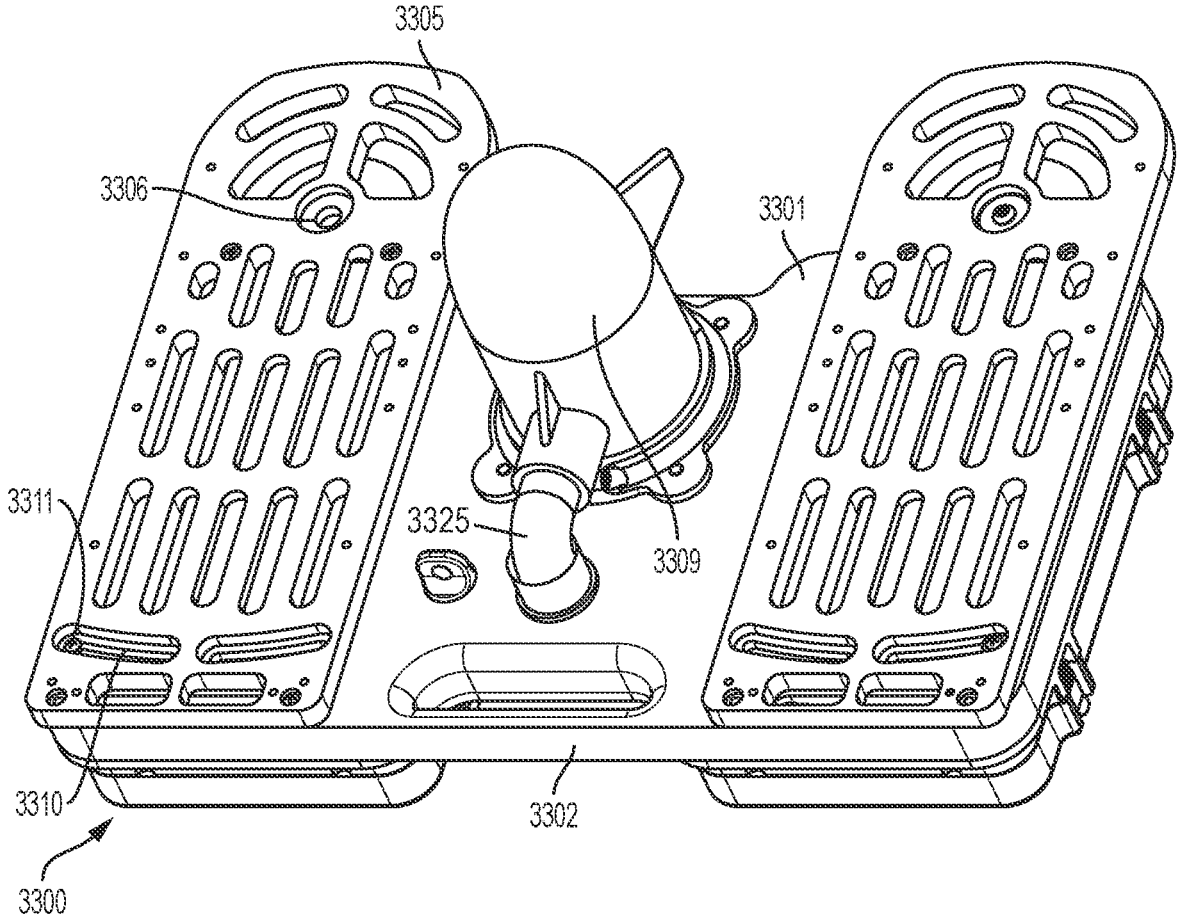
FIG. 34 is a top perspective view of the FIG. 33 embodiment.

Referring next to FIG. 33 an electronic foot control board 3300 is shown—a plan view of the underside (FIG. 34 shows the device from the top side). A base 3301 has a forward carry handle 3302. A propeller motor 3303 may be a DC voltage waterproof type powered by a rechargeable Lithium ion battery. Power leads and wiring are water tight and may be sealed in silicone or the like. A left foot pedal 3305 has a swivel mount 3306 to the base 3301 (a corresponding swivel mount in the right foot board is shown but not labeled). The user's boots strap or interlock securely to the swivel pedal via an attachment mechanism (as previously described in connection with to FIG. 1), and the swivel pedal is then capable has a hole that receives and locks to a projection from the underside of the toe of the user's boot, allowing the user to twist their feet in the base 3301 about an axis running through their toes, causing the heel ends of their boots to move side to side at the rear end of the base 3301. Note that this configuration could be easily reversed so that the heel end of the boots mounted to a swivel, and the toe end of the boots was allowed to move side to side.

A magnet (or equivalent transmitter) 3308 is attached to a rear section of the foot pedal 3305, and a magnet (or transmitter) sensor 3307 is connected to the base 3301. The sensor 3307 has an electronic connection to the motor speed controller 3309. The motor speed controller may be a pulse width modulated (PWM) type. The sensor 3308 may be a hall effect type. The position of the magnet and sensor could be reversed by design choice. The motor speed controller 3309 is a software flow processor that reads the state of the magnetic sensor 3307 in the main loop. If the sensor 3307 has been activated, the processor 3309 checks if the motor is running. If the motor 3303 is running and the sensor 3307 is held in an activated state for greater than X seconds, motor 3303 is turned off. If the motor is running and the sensor is activated for less than X seconds, the speed is increased one increment (unless already at top speed, in which case nothing happens). If the sensor 3307 is activated twice in a row and motor is running, speed is decreased one increment (unless already at bottom speed in which case nothing happens). If the motor is off, and the switch is held in activated state for greater than X seconds, motor is turned on at lowest speed.

Figure 46:
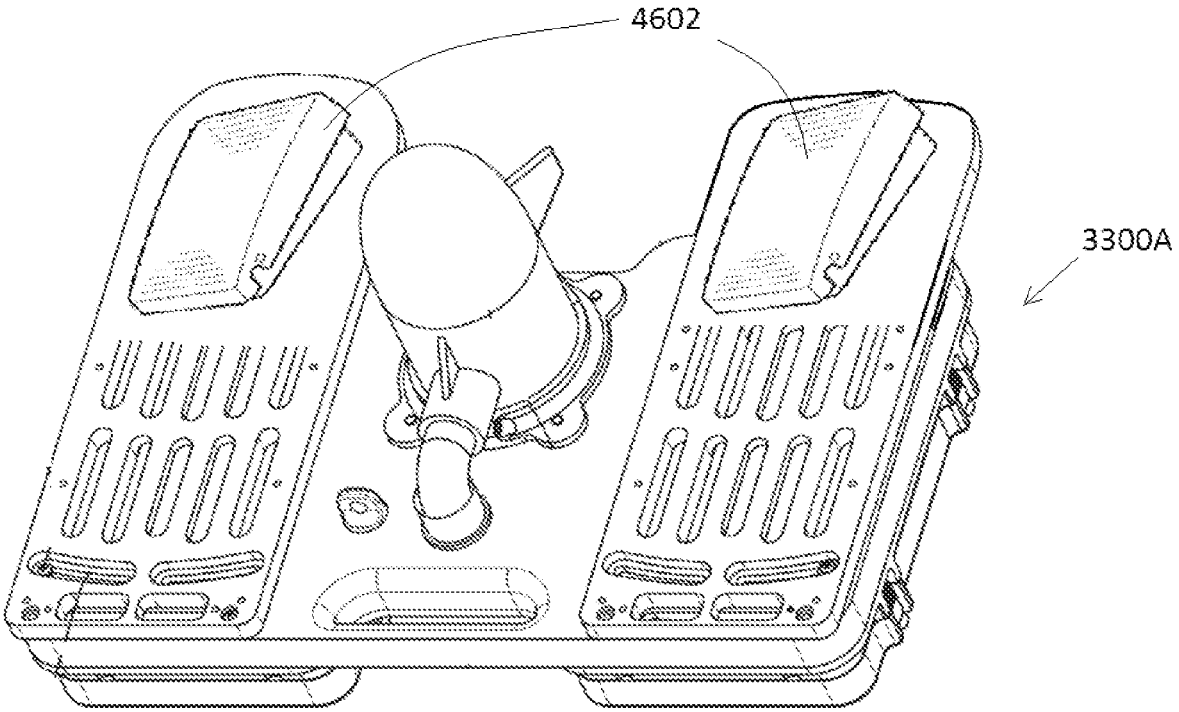
FIG. 46 is a front elevation view of another embodiment of the device.

As a more general matter, it may be appreciated that by virtue of the swivel pedal mounts and sensors, the user is able to control the throttle of the propulsion unit by twisting their boot (and thereby the foot pedal) on the surface of the base 3301 about the axis of the swivel mount, with a sensor detecting the extent of movement of the opposite (moving) end of the boot, and translating the extent of that movement into a desired amount of throttle. A foot movement other than a swivel may be enabled to control throttle by, for example, including a spring-mounted pedal below the user's toes which functions in a manner similar to an ordinary automobile gas pedal. Such an embodiment is shown in FIG. 46.

Figure 36:
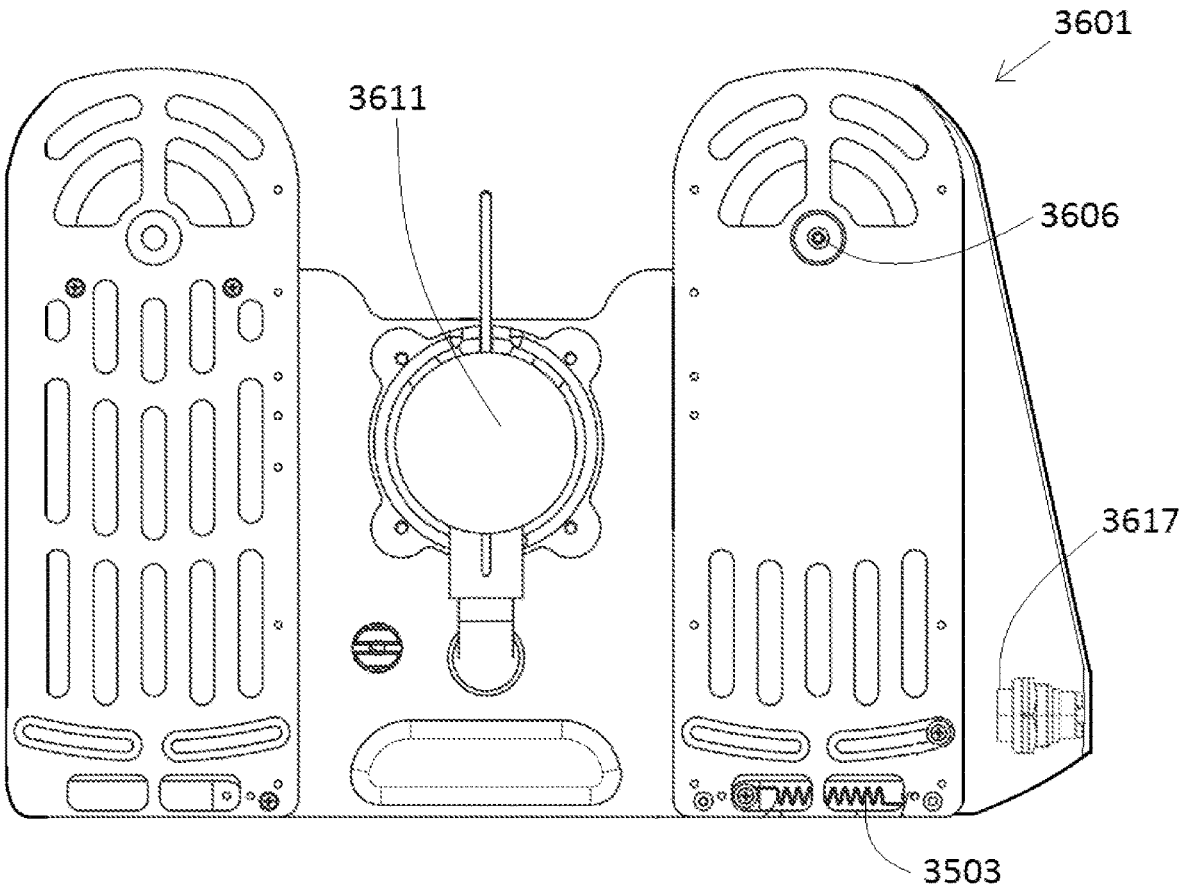
FIG. 36 is a top plan view of a foot pedal.

In the alternative to using the degree of movement of the foot to control throttle, the sensor 3307 may comprise an electrical switch connected to an electrical circuit and a microprocessor. In the switch embodiment, the microprocessor may be programmed such that each tripping of the switch by a foot movement causes the propulsion unit to cycle through different levels of thrust. For example, each new trip of the switch can increase throttle until a last click drops the throttle back to zero. The processor might also be programmed to change thrust based on a particular pattern of tripping of the switch, such as increasing throttle based on two switch trips in rapid succession. Referring to FIG. 36, and embodiment of a foot board 3601 is shown having propulsion unit 3611 and a foot pedal mounted to swivel 3606 and connected to spring return 3503 which tends to bring the foot pedal back to neutral position when the user does not exert any twisting force on the pedal. A switch 3617 with a button is affixed to a side extension of foot board 3601 and positioned such that it may be struck by the foot pedal when the user twists their foot and causes the foot pedal to pivot about swivel 3606.

Referring next to FIG. 34, the propulsion unit 3309 has a propeller P shown in FIG. 35 below the base 3301. As shown here, this propulsion unit is similar to that of a trolling motor (previously described) which provides more thrust than a conventional sea scooter. This design does not require any electronics to be mounted to the foot pedal 3305. Only the magnet 3307 (shown in FIG. 35) needs to be mounted on the swiveling foot pedal 3305. A forward slot 3310 can guide the foot pedal 3305 with a stopper 3311 functioning as a guide post and a maximum travel stopper. A watertight power line supply tube 3325 is shown leading from the battery compartment within the board to the propulsion unit 3309.

Figure 35:
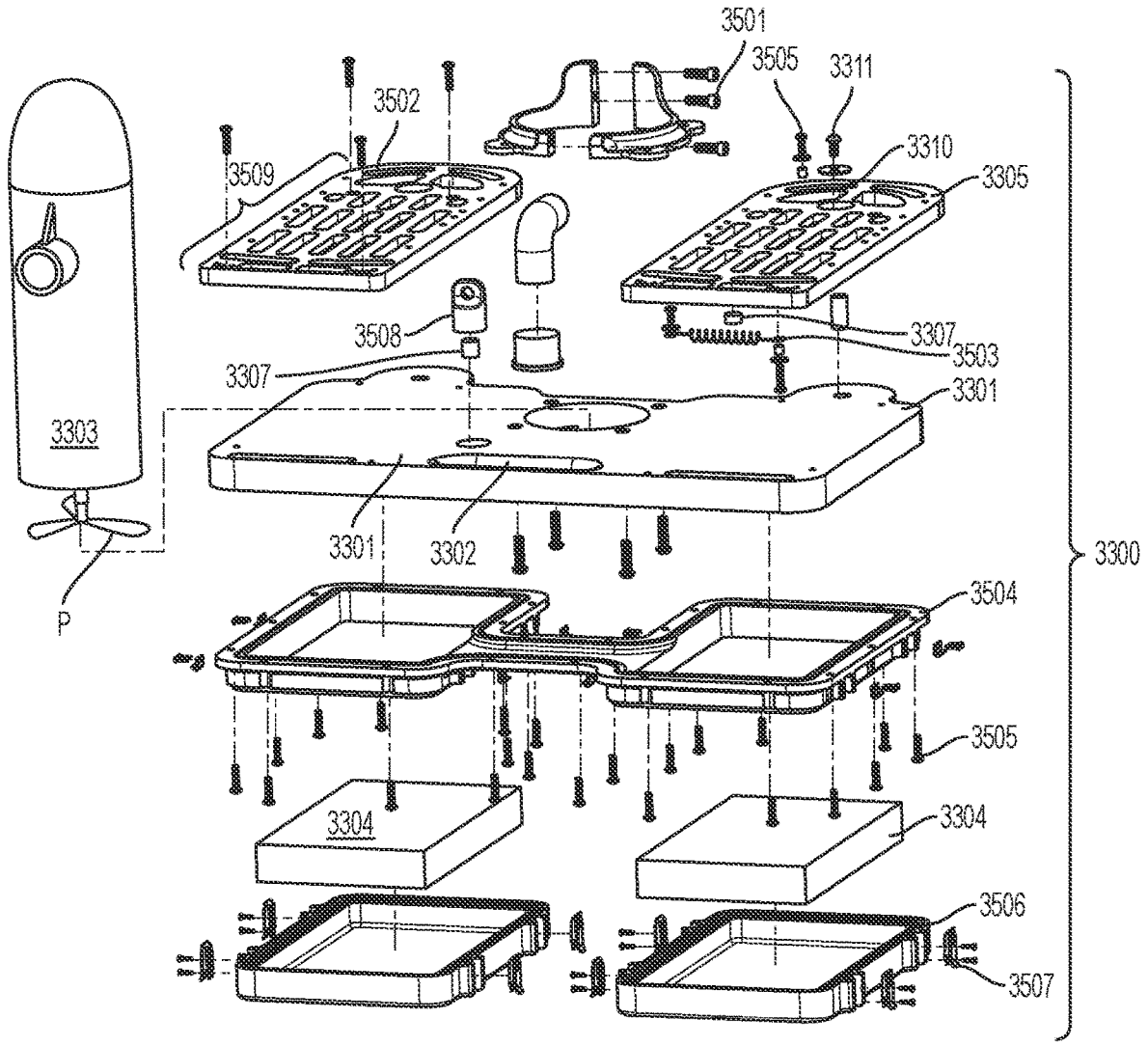
FIG. 35 is an exploded view of the FIG. 33 embodiment.

Referring next to FIG. 35 a bracket 3501 secures the motor 3303 to the base 3301. A right foot pedal 3502 and duplicate controls are optional. A kill switch 3508 has a tether 3509 to the leg of the user (not shown) wherein if the user becomes separates from the board, the user's leg will pull the tether and release the kill switch, turning the propulsion unit off. A spring return 3503 returns the foot pedal 3305 to a neutral straight ahead position. A platform spacer 3504 secures one or more batteries 3304. Screws 3505 are shown as needed. A battery cover 3506 has fasteners 3507 to quick connect to platform spacer 3504. A gasket traverses the top edge of cover 3506 and acts to seal the battery compartment when pressed against the spacer 3504, and the spacer 3504 in turn has a perimeter gasket that engages with the underside of board base 3301.

An advantage of a board design such as that shown in FIG. 35 is that the board is formed and configured as having a thin profile of, for example four inches or less, and the use of flattened batteries allows the thin profile to be maintained. A thin board of this kind is easily carried by the user, and its total weight with the integrated flattened batteries might only be approximately 30-40 pounds when the balance of the board is constructed largely of lightweight polymer materials. As used herein, the term "integrated" refers not only to placement within the body of the footboard, but also encompasses direct attachment to or on the foot board.

Figure 37:
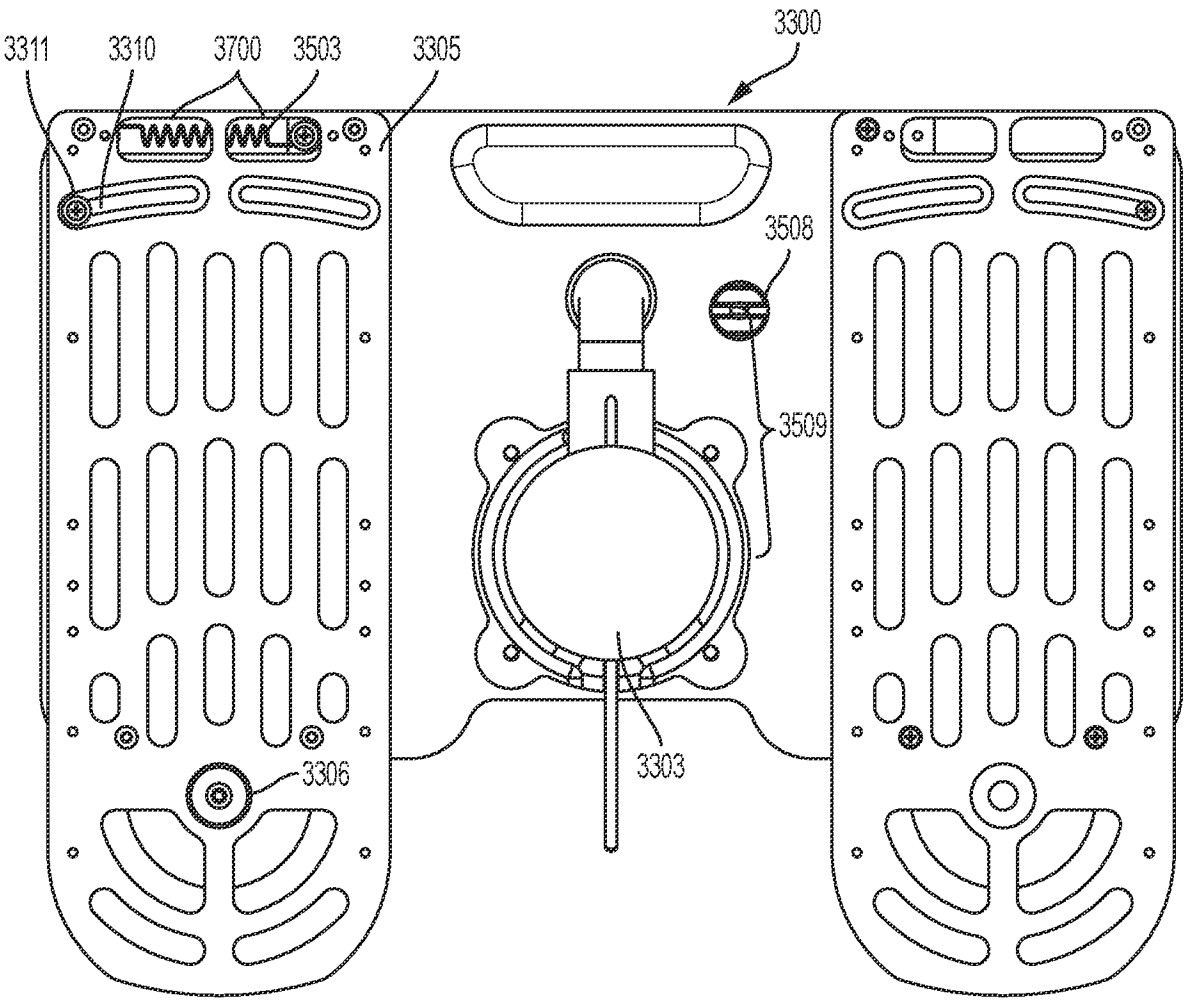
FIG. 37 is a top plan view of the foot board and kill switch.
Figure 38:
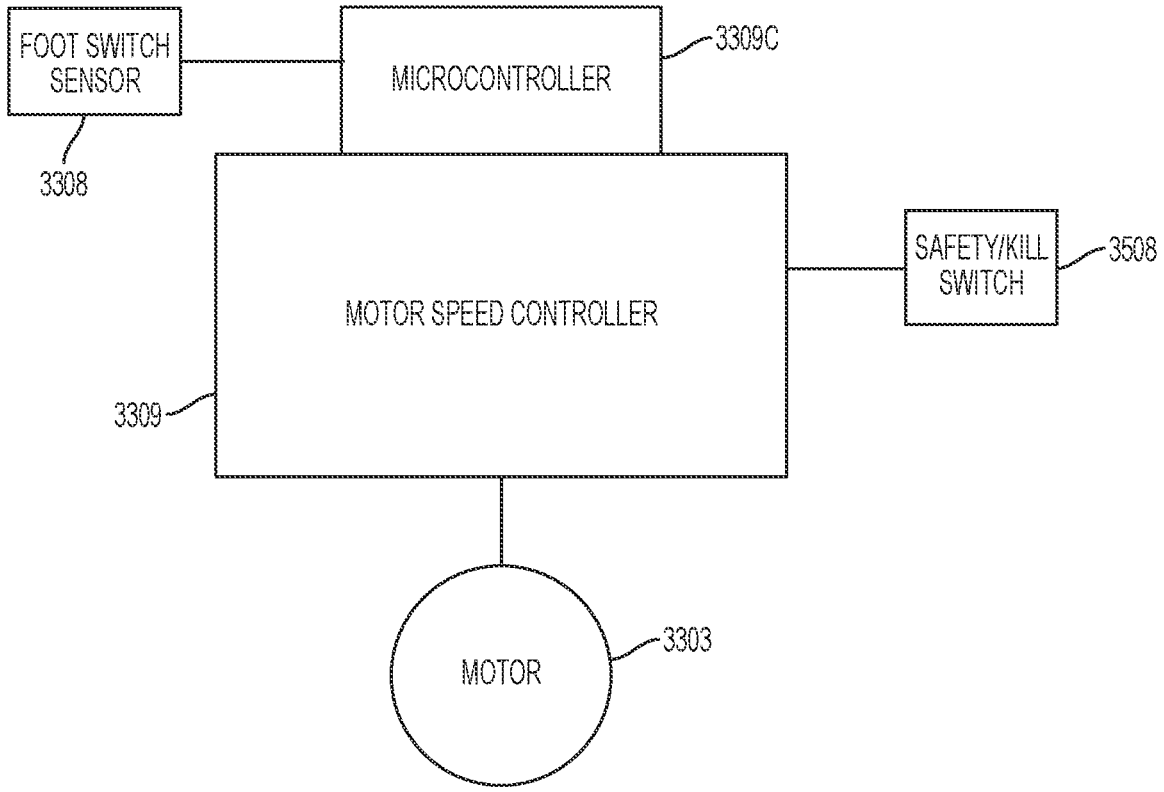
FIG. 38 is a diagram of the subsystems of the electronic control system.
Figure 39:
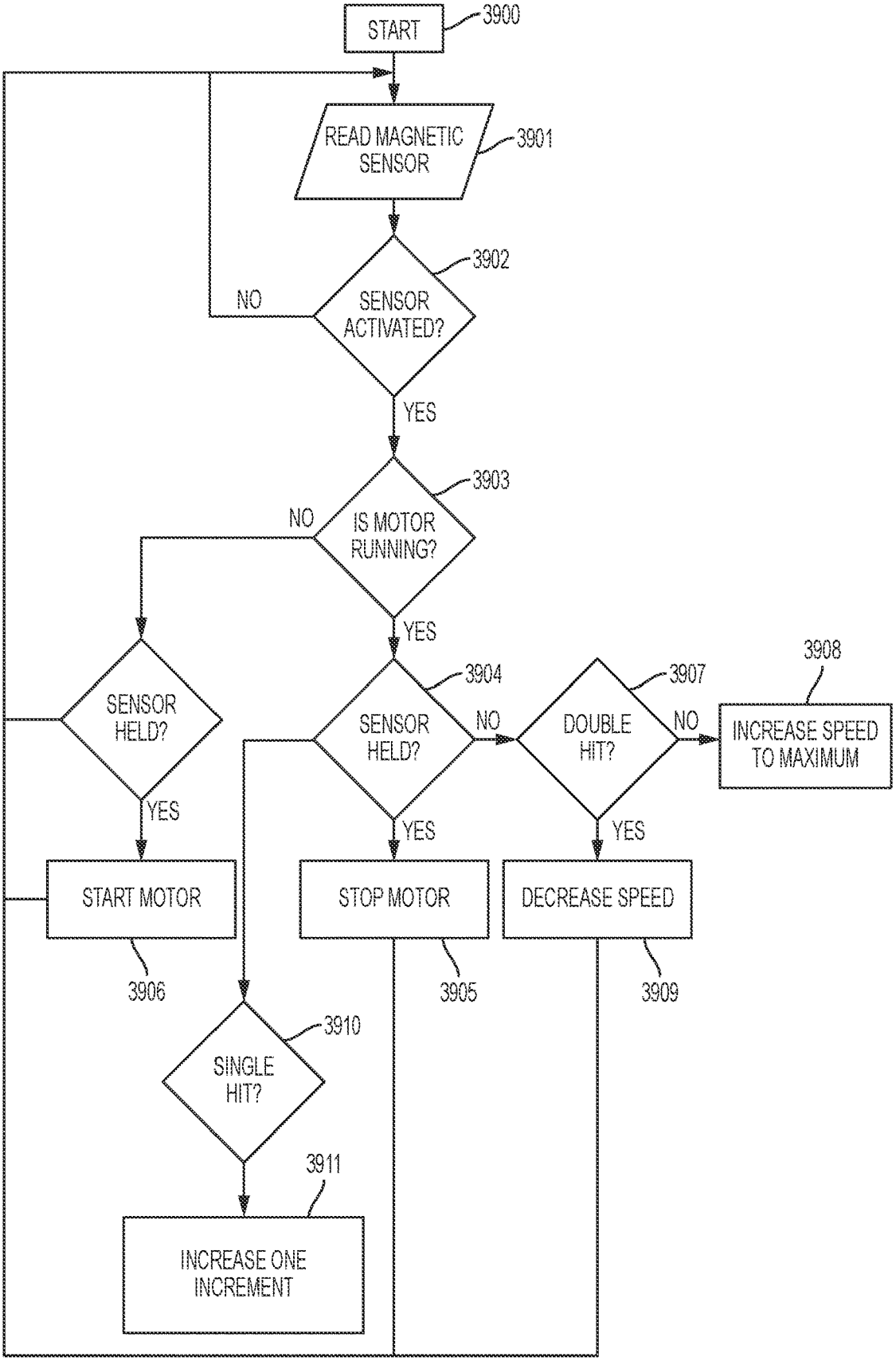
FIG. 39 is a flowchart of an embodiment of the control logic.

Referring next to FIG. 37, optional repair openings 3700 for the spring return 3503 are shown. Referring next to FIG. 38 the subsystem microcontroller 3309 C is programmed as shown in FIG. 39 or with many equivalent logic steps as known to one skilled in the art. A foot pedal movement or a switch (not shown) starts 3900. The logic in microcontroller 3309C. The sensor 3308 is read at 3901. If the sensor is activated in 3902 the logic proceeds to determining if the motor is running at 3903. If the sensor held ON at 3904, then stop the motor if the motor is running at 3905. If the motor was OFF, then start the motor at 3906. A double hit at 3907 either maximizes the speed at 3908, or if already at maximum speed, it decreases the speed at 3909, a single hit at 3910 can increase the speed one increment at 3911. Other variants on this programming and function are possible. The purpose is to enable the user to control throttle by use of a motion of their feet on the foot board.

Another computer-controlled system that is advantageous to employ with the disclosed devices is that of a depth-activated speed-limiter. In this embodiment, a depth gauge could be incorporated with the foot board, and electrically connected with the throttle control. Pre-set parameters could then be used to regulate the user's throttle based on depth, or the user could modify the parameters while the foot board is in use. Another kind of speed-limiter may be employed to pre-set the maximum speed of the foot board based on the level of skill of the user, or the anticipated diving conditions. Thus, the maximum speed of a beginner could be set lower, or the maximum speed could also be set lower for wreck-driving in close quarters.

Figure 40:
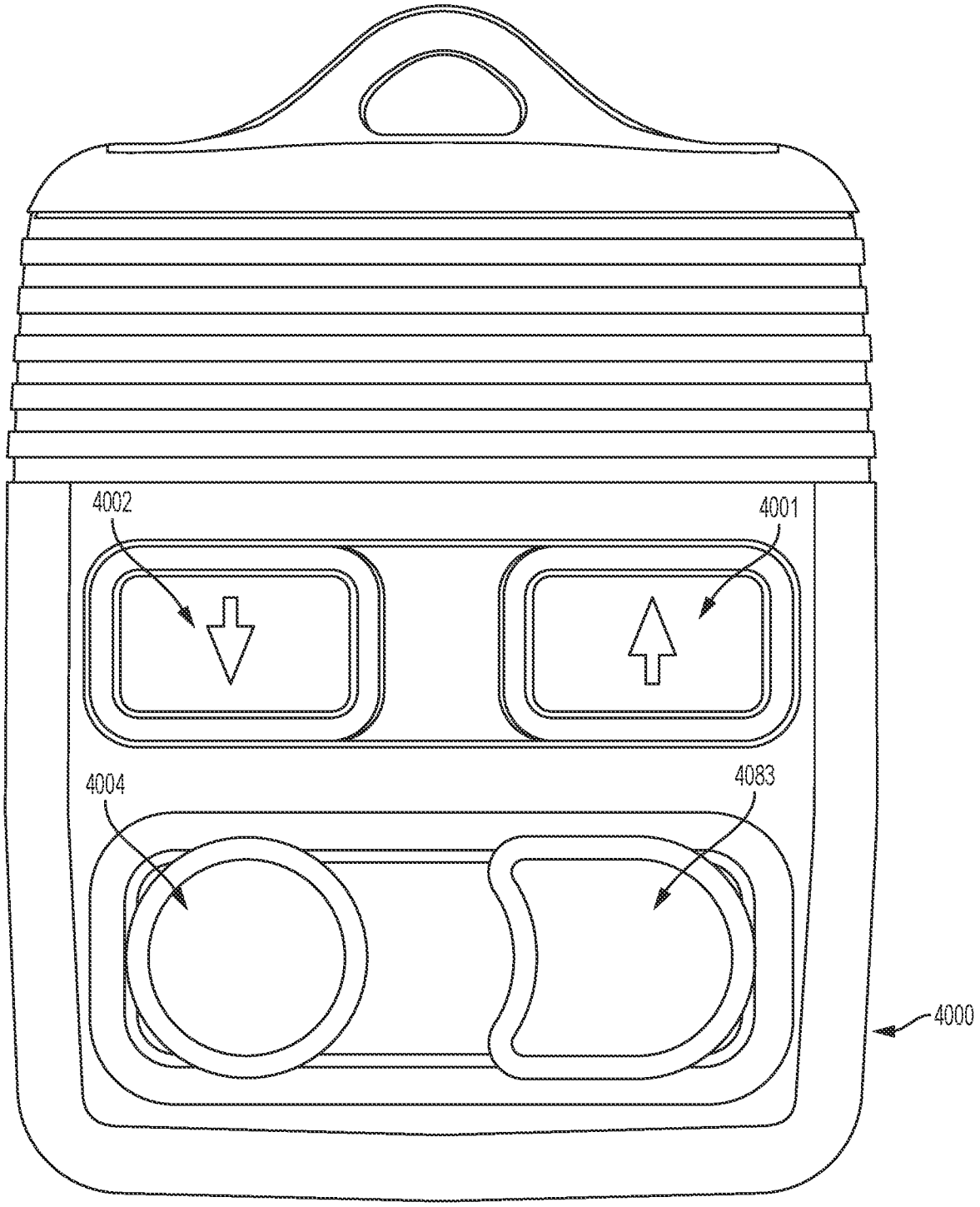
FIG. 40 is a top plan view of a sample hand control wireless embodiment controller.

Referring next to FIG. 40 an alternate embodiment remote 4000 could either replace a foot pedal or augment a foot pedal embodiment for a backup or user choice. An antenna (not shown) would be needed on a microcontroller and receiver (that usually reaches with a radio frequency up to nine feet underwater). A speed up 4001 or speed down 4002 and stop 4004 button, and start button 4003 is shown. Such a remote 4000 could be attached like a watch to the user's wrist.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

Figure 41A:
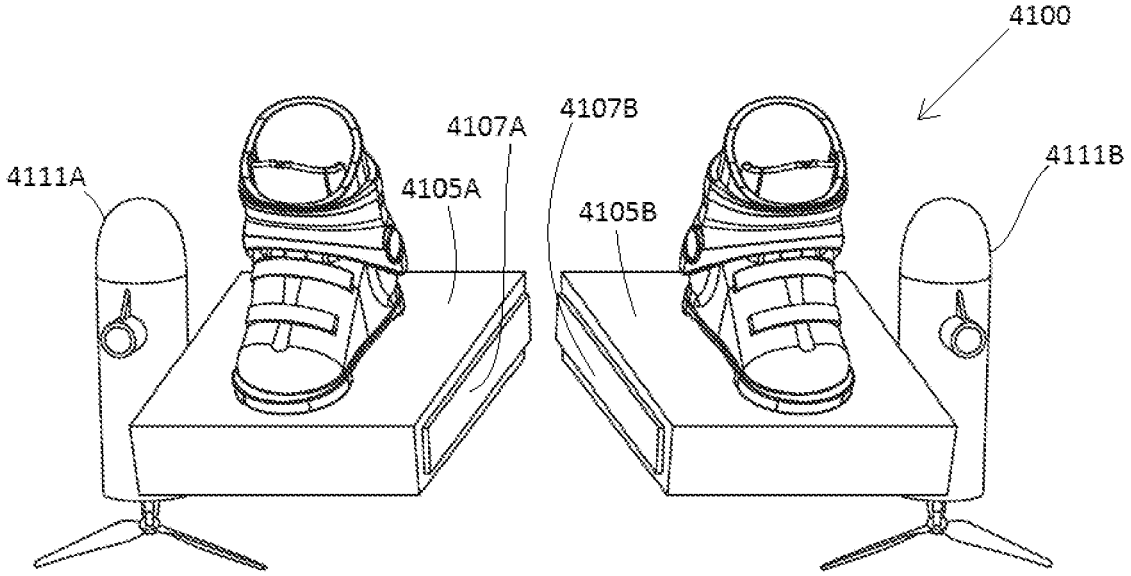
FIG. 41A is a front elevation view of another embodiment of the device.
Figure 41B:
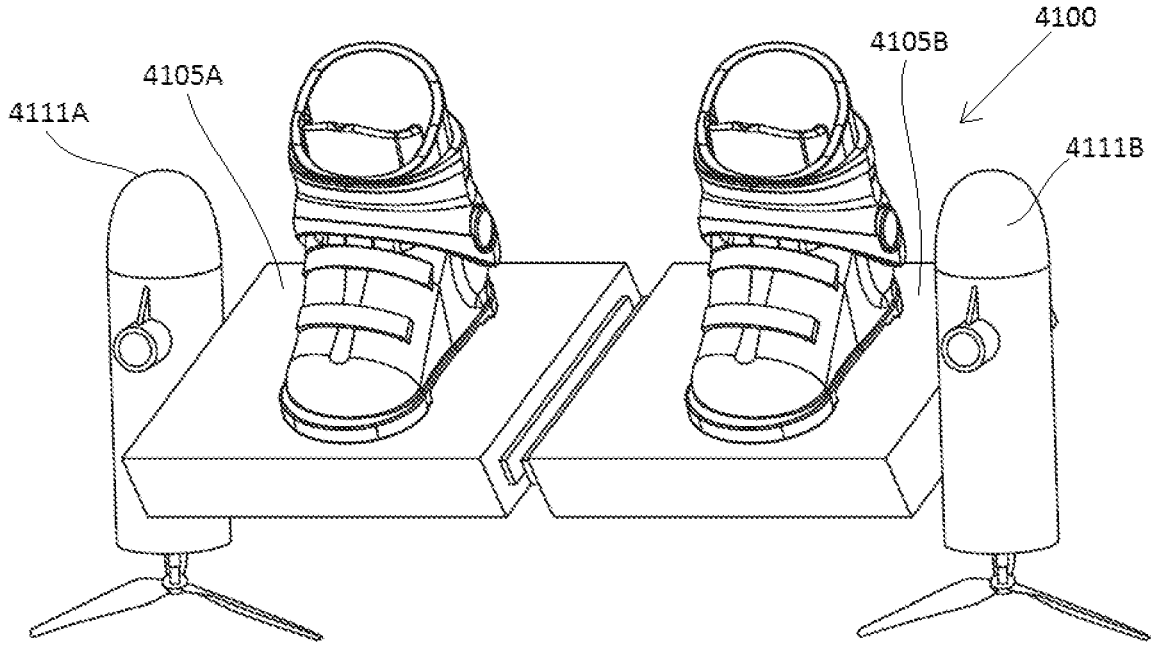
FIG. 41B is another front elevation view of the embodiment in FIG. 41A.

Referring now to FIGS. 41A and 41B, an embodiment is shown in which the foot board 4100 is separated into left and right halves 4105A and 4105B that are releasably connected by magnetic surfaces 4107A and 4107B that form a magnetic linkage when connected. Surface features of the boards, such as swiveling foot pedal mounts and throttle control, are not shown for simplicity. Lithium ion batteries may be sealed within the bodies of the left and right boards, with sealed leads connected to the propulsion units 4111A and 4111B, shown here as trolling motors. As shown in FIG. 41B, the two halves of the foot board may be snapped together by magnetic attraction. However, the strength of the magnets may be set so as to allow the user to unsnap the two board halves by applying a deliberate spreading force, or by sliding the halves parallel past each other. The magnets may also be configured so as to allow the two foot board halves to pivot individually from each other while remaining connected. Of course, two foot board halves may be joined together by rigid latches, or by a male-female rod connector to form a single connected board, but such a single connected board would not enable relative movement of one half to the other.

Figure 42A:
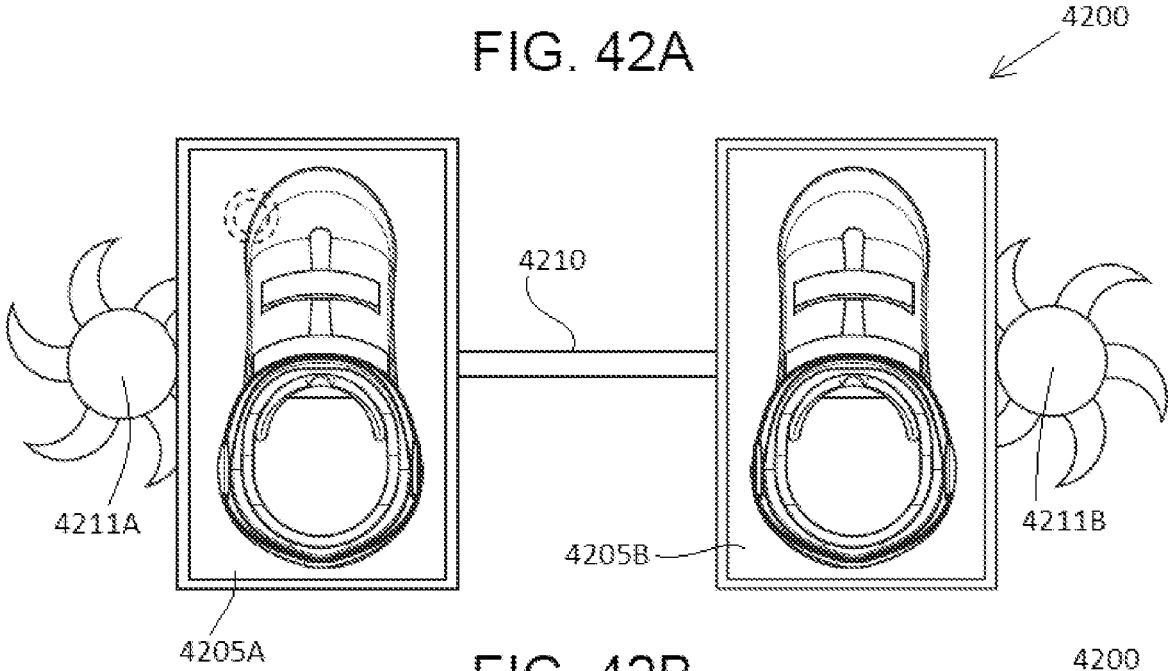
FIG. 42A is a front view of another embodiment of the device.
Figure 42B:
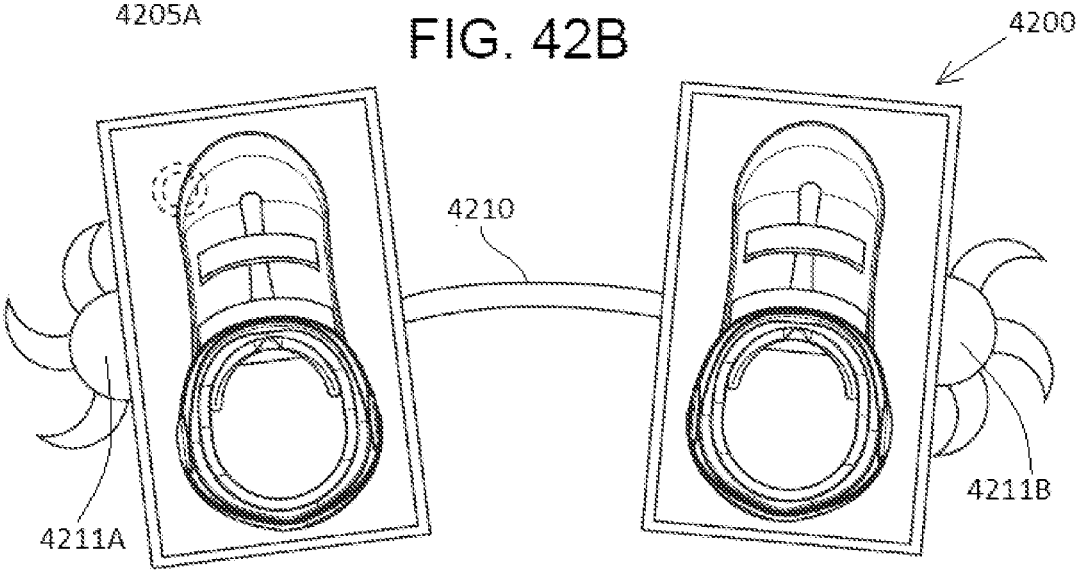
FIG. 42B is another front view of the embodiment in FIG. 42A.
Figure 42C:
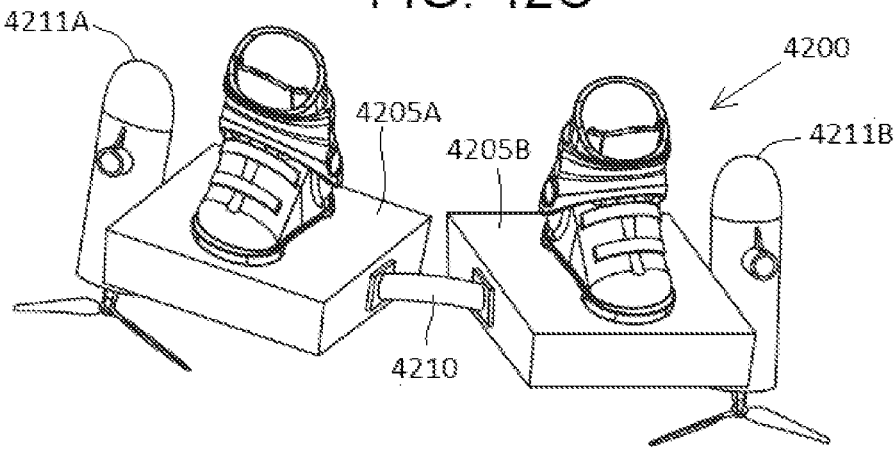
FIG. 42C is a front elevation view of the embodiment in FIG. 42A.

Referring next to FIGS. 42A, 42B, and 42C, a foot board 4200 is shown split into halves 4205A and 4205B. Surface features of the boards, such as swiveling foot pedal mounts and throttle control, are not shown for simplicity. Lithium ion batteries may be sealed within the bodies of the left and right boards, with sealed leads connected to the propulsion units 4211A and 4211B, shown here as trolling motors. A linkage 4210 holds the halves 4205A and 4205B together. This linkage 4210 may comprise a rigid rod of fixed length, mounted by bearings or swivel mounts in the inner sides of each half 4205A and 4205B to allow the halves to pivot with respect to one another. For example, one half of the board may protrude a male rod that motes with a bearing on the opposing half of the board. Alternatively, linkage 4210 may comprise a flexible connector such as a heavy polymer material that tends to return to a straight rod shape, but which may be bent or twisted in infinite directions under force by the user's boots, as shown in FIGS. 42B and 42C, thus allowing the halves 4205A and 4205B to assume a wide range of different relative positions and orientations with respect to one other. Alternatively, the linkage 4210 could be made of a limp yet durable material (such as polymer rope) that allow completely unconstrained relative movement of the halves 4205A and 4205B, while preventing the halves from separating more than the pre-determined distance of the linkage. As known in the art generally of straps, such linkage can be made length adjustable.

Figure 43:
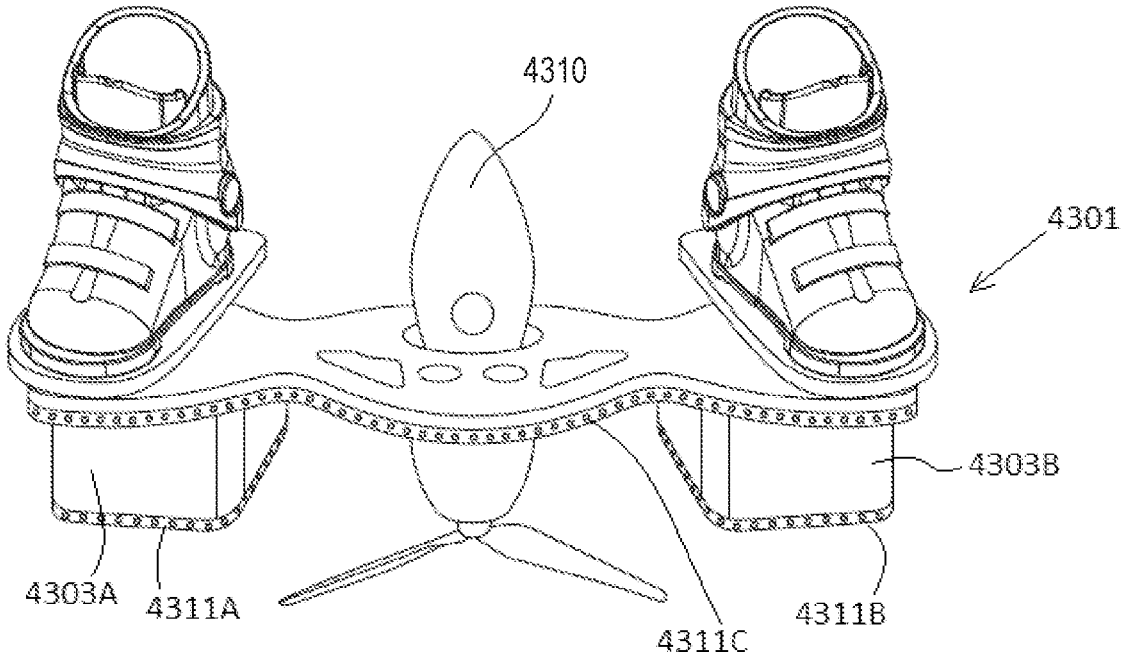
FIG. 43 is a front elevation view of another embodiment of the device.

Referring to FIG. 43, an embodiment is shown of foot board 4301 wherein a string of watertight LED lights 4311C encircles the perimeter of the board, and may be used to locate divers underwater in dark or murky conditions. Further strings of LEDs 4311A and 4311B are shown encircling the rim on enlarged battery casings 4303A and 4303B designed to accommodate large sized batteries for greater battery life for the combined motor and lighting system.

Figure 44:
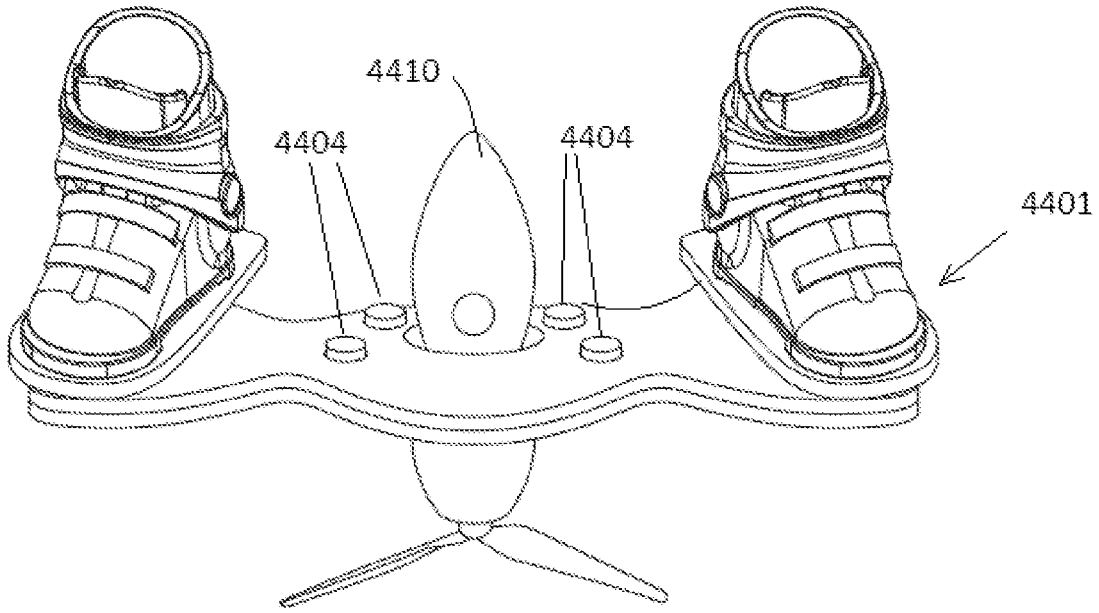
FIG. 44 is a front elevation view of another embodiment of the device.

Referring to FIG. 44, an embodiment is shown of board 4401 that is provided with optional dive weights 4404 that may be inserted into correspondingly shaped slots in board 4401. The board may be constructed so as to be neutrally buoyant in fresh water, with the ability to add weights as ballast in salt water.

Figure 45:
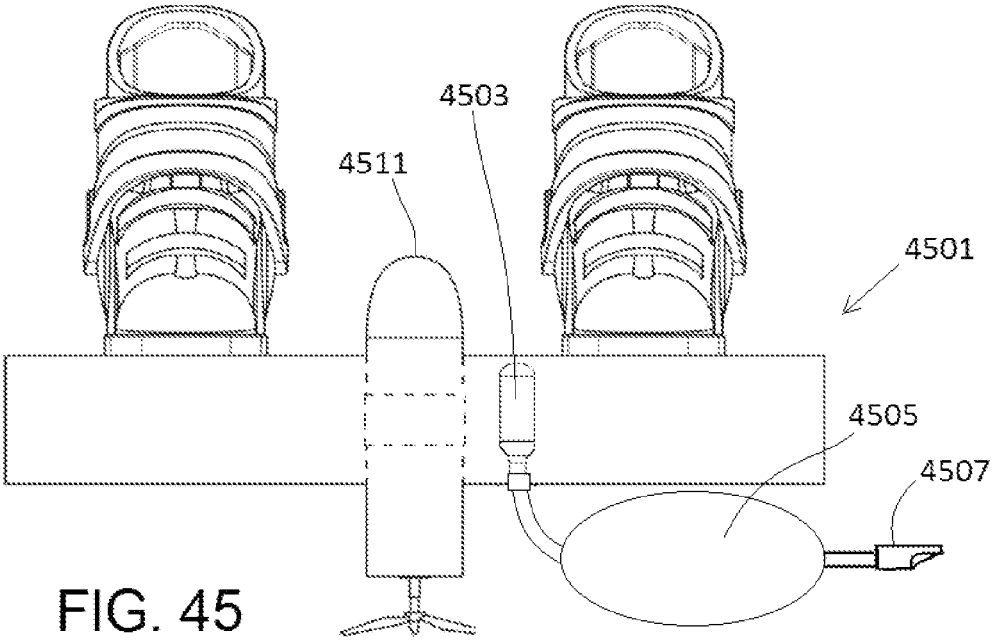
FIG. 45 is a side cross-sectional view of another embodiment of the device.

Referring to FIG. 45, an embodiment is shown of foot board 4501 that includes a small pressurized air tank 4503 filled with compressed CO2 or the like capable of being released by the user to inflate bladder 4505, which can be used to automatically send the board 4501 to the surface of the water if the user becomes separated from the board or otherwise wants to send it to the surface separately. A release valve 4507 is also provided.

Referring to FIG. 46, an embodiment 3300A of the foot board 3300 previously shown in FIG. 34 is presented wherein the throttle switches are toe pedals 4602.

Although the invention has been described in terms of exemplary embodiments, it is not limited thereto. Rather, the appended claims should be construed broadly, to include other variants and embodiments of the invention, which may be made by those skilled in the art without departing from the Scope and range of equivalents of the invention.

The invention claimed is:

1. An underwater propulsion device comprising:

(a) a foot board;

(b) a battery sealed in a watertight compartment that is integrated with said foot board;

(c) wherein said foot board has a surface with two attachment structures, one for each of said user's feet;

(d) wherein two battery-powered underwater propulsion units are mounted on opposite outer sides of said foot board adjacent to the outer sides of each of said user's feet;

(e) a throttle control system integrated with said foot board that allows the throttle of said propulsion unit to be controlled by a swivel movement of said user's foot, wherein at least one of said foot attachment structures comprises a foot pedal mount that fixes one end of said user's foot to said foot board about a rotational axis that allows the opposite end of said user's foot to swivel from side to side; and wherein said throttle control system further includes a tensioned return which tends to bring said user's foot to neutral position when said user does not exert any swivel force with their foot.

2. The device of claim 1 wherein said foot board comprises two portions, each supporting one of said attachment structures for one of said user's feet, and wherein said portions are connectable to one another by a linkage that permits said portions to pivot relative to one another; and wherein there are two of said batteries, one within each of said two portions of said foot board.

3. The device of claim 1 wherein said throttle control system includes a sensor that is capable of detecting swivel movement of said foot pedal mount, and translating the extent of said swivel movement into a desired amount of throttle.

4. The device of claim 1 including an electrical switch and a programmable microprocessor, wherein each time said user swivels their foot it trips said switch, and wherein each successive tripping of said switch is programmed to cause said throttle control system to cycle through to a different level of thrust.

5. The device of claim 1 wherein said propulsion unit includes an electric motor contained within a watertight casing, and wherein the negative space within said casing is filled with oil.

6. The device of claim 1 further comprising a speed limiter connected with a depth gauge wherein the maximum speed of said device is programmable to change based on the depth of the device underwater.

* * * * *